US006409567B1

(12) United States Patent
Amey, Jr. et al.

(10) Patent No.: US 6,409,567 B1
(45) Date of Patent: Jun. 25, 2002

(54) PAST-DEPOSITED CARBON ELECTRON EMITTERS

(75) Inventors: Daniel Irwin Amey, Jr., Durham, NC (US); Robert Joseph Bouchard; Syed Ismat Ullah Shah, both of Wilmington, DE (US); John Gerard Lavin, Swarthmore, PA (US)

(73) Assignee: E.I. du Pont de Nemours and Company, Wilmington, DE (US)

( * ) Notice: Subject to any disclaimer, the term of this patent is extended or adjusted under 35 U.S.C. 154(b) by 0 days.

(21) Appl. No.: 09/250,774

(22) Filed: Feb. 12, 1999

Related U.S. Application Data

(63) Continuation-in-part of application No. PCT/US98/26016, filed on Dec. 8, 1998.

(60) Provisional application No. 60/069,453, filed on Dec. 15, 1997.

(51) Int. Cl.[7] ..... H01J 9/04; H01J 9/12

(52) U.S. Cl. ..... 445/50; 445/51; 445/24; 445/35

(58) Field of Search ..... 313/495, 310; 445/50, 51, 24, 35

(56) References Cited

U.S. PATENT DOCUMENTS

| | | | | |
|---|---|---|---|---|
| 4,857,799 A | 8/1989 | Spindt et al. | ..... | 313/495 |
| 5,015,912 A | 5/1991 | Spindt et al. | ..... | 313/495 |
| 5,686,791 A | 11/1997 | Kumar et al. | ..... | 313/495 |
| 5,697,827 A | 12/1997 | Rabinowitz | ..... | 445/60 |
| 6,057,637 A * | 5/2000 | Zettl et al. | ..... | 313/310 |

FOREIGN PATENT DOCUMENTS

| | | | | |
|---|---|---|---|---|
| EP | 0 700 065 A1 | 3/1996 | | |
| GB | 9706549 * | 2/1997 | ..... | 313/310 |
| GB | 2 306 246 A | 4/1997 | | |
| WO | WO 94/15350 | 7/1994 | | |
| WO | WO 94/15352 | 7/1994 | | |
| WO | WO 94/28571 | 12/1994 | | |
| WO | WO 96/00974 | 1/1996 | | |
| WO | WO 97/06549 | 2/1997 | | |
| WO | WO 97/18576 A | 5/1997 | | |

OTHER PUBLICATIONS

L.A. Chernozatonski, et al., Electron Field Emissin From Nanofilament Carbon Films, *Chemical Physics Letters*, 233, 63–68, Feb. 3, 1995.

L. A. Chernozatonskii, et al., Nanotube Carbon Structure Tips—A Source of High Field Emission of Electrons, *Mat. Res. Soc. Symp. Proc.*, 359, 99–105, 1995.

B. H. Fishbine, et al., Buckytube Cold Field Emitter Array Cathode Experiments, *Mat. Res. Soc. Symp. Proc*, 359, 93–98, 1995.

J. A. Floro, et al., Ion–Bombardment–Induced Whisker Formation On Graphite, *J. Vac. Sci. Technol.*, A1, 1398–1402, 1983.

J. A. van Vechten, et al., Kink Site Saturation Mechanism For Whisker Growth Under Sputtering Conditions, *J. Crystal Growth*, 82, 289–294, 1987.

S. Bajic, et al., Enhanced Cold–Cathode Emission Using Composite Resin–Carbon Coatings, *J. Phys. D: Appl. Phys.*, 21, 200–204, 1988.

M. S. Dresselhaus, et al., Graphite Fibers and Filaments, *Springer–Verlag, Berlin*, 32–34, 1988.

T. Asano, et al., Field Emissin From Ion–Milled Diamond Films On Si, *J. Vac. Sci. Technol.*, B13, 431–434, 1995.

C. Nutzenadel, et al., Electron Field Emission From Diamond Tips Prepared By Ion Sputtering, *Appl. Phys. Lett.*, 69, 2662–2664, 1996.

* cited by examiner

*Primary Examiner*—Kenneth J. Ramsey
*Assistant Examiner*—Mariceli Santiago

(57) ABSTRACT

Patterned ion-bombarded carbon electron emitters and the processes for producing them. The electron emitters are produced by forming a layer of composite of carbon particles and glass on a substrate then bombarding the composite with an ion beam. The electron emitters are useful in field emitter cathode assemblies which are fabricated into flat panel displays.

37 Claims, 19 Drawing Sheets

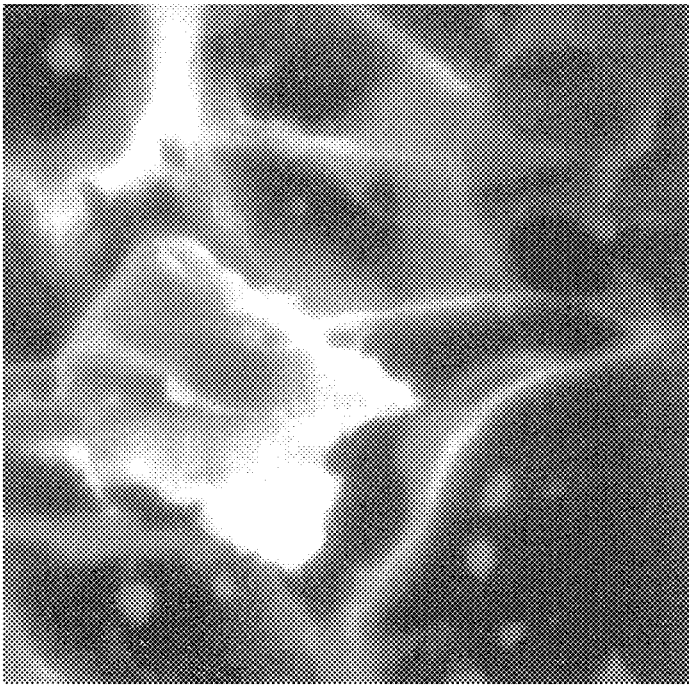
FIG. 6a
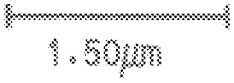
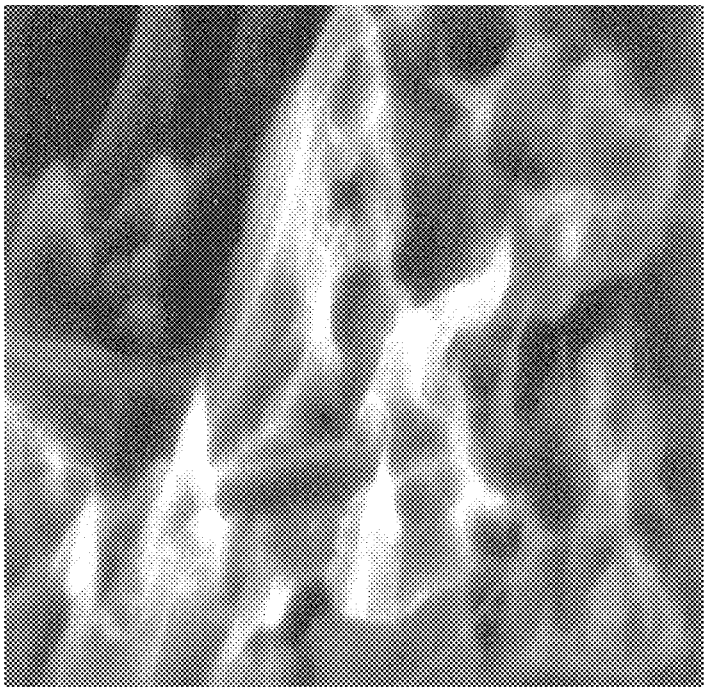
FIG. 6b
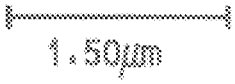

PAST-DEPOSITED CARBON ELECTRON EMITTERS

This application is a continuation-in-part of PCT/U.S. 98/26076 filed Dec. 8, 1998. Which claim benefit to provisional 60/069,453 filed Dec. 15, 1997.

FIELD OF THE INVENTION

The invention generally provides for patterned ion-bombarded graphite field emission electron emitters, processes for producing them and their use in field emitter cathode assemblies in flat panel displays.

BACKGROUND OF THE INVENTION

Field emission electron sources, often referred to as field emission materials or field emitters, can be used in a variety of electronic applications, e.g., vacuum electronic devices, flat panel computer and television displays, emission gate amplifiers and klystrons and in lighting.

Display screens are used in a wide variety of applications such as home and commercial televisions, laptop and desktop computers and indoor and outdoor advertising and information presentations. Flat panel displays are only a few inches thick in contrast to the deep cathode ray tube monitors found on most televisions and desktop computers. Flat panel displays are a necessity for laptop computers, but also provide advantages in weight and size for many of the other applications. Currently laptop computer flat panel displays use liquid crystals which can be switched from a transparent state to an opaque one by the application of small electrical signals. It is difficult to reliably produce these displays in sizes larger than that suitable for laptop computers or for operation over a wide temperature range.

Plasma displays have been used as an alternative to liquid crystal displays. A plasma display uses tiny pixel cells of electrically charged gases to produce an image and requires relatively high electrical power to operate.

Flat panel displays having a cathode assembly using a field emission electron source, i.e., a field emission material or field emitter, and a phosphor capable of emitting light upon bombardment by electrons emitted by the field emitter have been proposed. Such displays have the potential for providing the visual display advantages of the conventional cathode ray tube and the depth and weight advantages of the other flat panel displays with the additional advantage of lower power consumption than the other flat panel displays. U.S. Pat. Nos. 4,857,799 and 5,015,912 disclose matrix-addressed flat panel displays using micro-tip cathodes constructed of tungsten, molybdenum or silicon. WO 94-15352, WO 94-15350 and WO 94-28571 disclose flat panel displays wherein the cathodes have relatively flat emission surfaces.

Field emission has been observed in two kinds of nanotube carbon structures. L. A. Chernozatonskii et al., Chem. Phys. Letters 233, 63 (1995) and Mat. Res. Soc. Symp. Proc. Vol. 359, 99 (1995) have produced films of nanotube carbon structures on various substrates by the electron evaporation of graphite in $10^{-5}$–$10^{-6}$ torr. These films consist, of aligned tube-like carbon molecules standing next to one another. Two types of tube-like molecules are formed; the A-tubelites whose structure includes single-layer graphite-like tubules forming filaments-bundles 10–30 nm in diameter and the B-tubelites, including mostly multilayer graphite-like tubes 10–30 nm in diameter with conoid or dome-like caps. They report considerable field electron emission from the surface of these structures and attribute it to the high concentration of the field at the nanodimensional tips. B. H. Fishbine et al., Mat. Res. Soc. Symp. Proc. Vol. 359, 93 (1995) discuss experiments and theory directed towards the development of a buckytube (i.e., a carbon nanotube) cold field emitter array cathode.

R. S. Robinson et al ., J. Vac. Sci. Technolo. 21, 1398 (1983) disclose the formation of cones on the surfaces of substrates under ion bombardment. The effect was reported for various substrate materials and were generated by simultaneously sputtering a surface at high energy while seeding it with impurity atoms deposited at low energy. They also disclosed the formation of carbon whiskers up to 50 $\mu$m in length when a graphite substrate was ion-bombarded with impurities from a stainless steel target.

J. A. Floro et al., J. Vac. Sci. Technolo. A 1, 1398 (1983) disclose the formation of whiskers during relatively high current density ion bombardment of heated graphite substrates. The whiskers were disclosed to be 2–50 $\mu$m in length and 0.05–0.5 $\mu$m in diameter and to grow parallel to the ion beam. Simultaneous impurity seeding was reported to inhibit whisker growth. J. A. van Vechten et al., J. Crystal Growth 82, 289 (1987) discuss the growth of whiskers from graphite surfaces under ion sputtering conditions. They note that the whiskers of smallest diameter, characteristically about 15 nm, definitely appear to be different from either diamond or the scrolled-graphite structure found in carbon fibers grown by catalytic pyrolysis of hydrocarbons. Larger whiskers with diameters ranging from 30 to 100 nm were also observed to grow in sputtering systems. The smaller diameter whiskers are constant in diameter along the length while the larger diameter whiskers may have a slight taper.

M. S. Dresselhaus et al., Graphite Fibers and Filaments (Springer-Verlag, Berlin, 1988), pp. 32–34, disclose that filaments may be grown on several types of hexagonal carbon surfaces, but not on diamond or glassy carbon.

T. Asano et al., J. Vac. Sci. Technol. B 13 , 431 (1995) disclose increased electron emission from diamond films which have been deposited on silicon by chemical vapor deposition, argon ion milled to form diamond cones and then annealed at 600° C. These cones are formed if the diamond is in the form of isolated grains.

C. Nützenadel et al., Appl. Phys. Lett. 69, 2662 (1996) disclose field emission from cones etched into both synthetic boron-doped diamond and silicon by ion sputtering.

S. Bajic et al., J. Phys. D: Appl. Phys. 21, 200 (1988) disclose a field emitter composite with graphite particles suspended in a resin layer.

R. A. Tuck et al., WO 97/06549, disclose a field emission material comprising an electrically conductive substrate and, disposed thereon, electrically conductive particles embedded in, formed in, or coated by a layer of inorganic electrically insulating material to define a first thickness of the insulating material between the particle and the substrate and a second thickness of the insulating material between the particle and the environment. The field emitting material may be printed onto a substrate.

M. Rabinowitz, U.S. Pat. No. 5,697,827, discloses a method and apparatus for producing, maintaining and generating a cathode source of thermo-field assisted emission of electrons and regeneration of the electric field enhancing whisker component of this source. The only carbon whiskers disclosed were carbon nanotubes. To form the cathode these nanotubes are bonded to a support by propelling them by an electric field and thereby embedding them into a soft material shell surrounding the support.

Despite the prior art, there is a need for a process for readily and economically producing both small and large sized highly emitting field emission electron emitters for use in various flat panel applications. Other objects and advantages of the present invention will become apparent to those skilled in the art upon reference to the drawings and detailed description which follow hereinafter.

SUMMARY OF THE INVENTION

The invention provides a process for producing a field emission electron emitter, which comprises the steps of:

(a) forming a layer of composite which comprises graphite particles and glass on a substrate, wherein the glass adheres to the substrate and to portions of the graphite particles thereby affixing the graphite particles to one another and to the substrate and wherein at least 50% of the surface area of the layer of composite consists of portions of graphite particles, and (b) bombarding the surface of the layer formed in (a) with an ion beam which comprises ions of argon, neon, krypton or xenon for a time sufficient to form whiskers on said graphite particles.

Preferably, at least 70% of the surface area of the layer of composite consists of portions of graphite particles.

The volume per cent of graphite particles is about 35% to about 80% of the total volume of the graphite particles and the glass, preferably about 50% to about 80% of the total volume.

The invention also provides a process for producing a field emission electron emitter wherein the composite further comprises electrically conducting material.

Preferably, the ion beam is an argon ion beam and the argon ion beam has an ion current density of from about 0.1 $mA/cm^2$ to about 1.5 $mA/cm^2$, a beam energy of from about 0.5 keV to about 2.5 keV and the period of ion bombardment is about 15 minutes to about 90 minutes. More preferred are ion beam gas compositions comprising argon and nitrogen.

Preferably, the glass is a low softening point glass.

Preferably, the electrically conducting material is silver or gold.

Preferably, when the layer of composite comprises graphite and glass, the process for forming the layer of composite on a substrate comprises screen printing a paste comprised of graphite particles and glass frit onto the substrate in the desired pattern and firing the dried patterned paste. For a wider variety of applications, e.g., those requiring finer resolution, the preferred process comprises screen printing a paste which further comprises a photoinitiator and a photohardenable monomer, photopatterning the dried paste and firing the patterned dried paste.

Preferably, when the layer of composite further comprises an electrically conducting material, the process for forming the layer of composite on a substrate comprises screen printing a paste comprised of graphite, glass frit and an electrically conducting material onto the substrate in the desired pattern and firing the dried patterned paste. For a wider variety of applications, e.g., those requiring finer resolution, the preferred process comprises screen printing a paste which further comprises a photoinitiator and a photohardenable monomer, photopatterning the dried paste and firing the patterned dried paste.

Preferably, when the substrate is glass, the dried patterned paste is fired at a temperature of about 450° C. to about 575° C., most preferably at about 525° C., for about 10 minutes. Preferably, the thickness of the fired layer of composite is from about 5 $\mu$m to about 30 $\mu$m.

The invention also provides a screen printable or coatable paste that can be used in the preferred process for forming a layer of composite comprising graphite and glass on a substrate. Based on the total weight of the paste, the paste contains about 40 wt % to about 60 wt % solids. The solids are comprised of graphite particles and glass frit or graphite, glass frit and an electrically conducting material. The volume per cent of graphite particles is about 35% to about 80% of the total volume of solids, preferably about 50% to about 80% of the total volume. The graphite particle size is preferably about 0.5 $\mu$m to about 10 $\mu$m.

In addition, the invention provides a process for forming a layer of composite which comprises graphite and glass on a substrate, which comprises:

(a) screen printing a paste comprised of graphite particles and glass frit onto the substrate in a desired pattern, wherein the volume per cent of graphite particles is about 35% to about 80% of the total volume of the graphite particles and the glass frit, and (b) firing the dried patterned paste to soften the glass frit and cause it to adhere to the substrate and to portions of the graphite particles thereby affixing the graphite particles to one another and to the substrate to produce the layer of composite, wherein at least 50% of the surface area of the layer of composite consists of portions of graphite particles.

Preferably, at least 70% of the surface area of the layer of composite consists of portions of graphite particles.

The invention also provides a process for forming a layer of composite which comprises graphite and glass on a substrate, which comprises:

(a) screen printing a paste comprised of graphite particles, glass frit, a photoinitiator and a photohardenable monomer onto the substrate, wherein the volume per cent of graphite particles is about 35% to about 80% of the total volume of the graphite particles and the glass frit, (b) photopatterning the dried paste, and (c) firing the patterned dried paste to soften the glass frit and cause it to adhere to the substrate and to portions of the graphite particles thereby affixing the graphite particles to one another and to the substrate to produce the layer of composite, wherein at least 50% of the surface area of the layer of composite consists of portions of graphite particles.

Preferably, at least 70% of the surface area of the layer of composite consists of portions of graphite particles In addition, the invention provides for a layer of composite which comprises graphite and glass on a substrate made by the above process and which can be subsequently treated to produce a field emission electron emitter. In the layer of composite which comprises graphite and glass, the volume per cent of graphite particles is about 35% to about 80% of the total volume of the graphite particles and the glass, preferably about 50% to about 80% of the total volume.

The invention also provides electron emitters produced by the process of this invention. These electron emitters and field emitter cathode assemblies made therefrom are useful in vacuum electronic devices, flat panel computer and television displays, emission gate amplifiers, klystrons and lighting devices. The panel displays can be planar or curved.

The panel displays provided by the present invention comprise a cathode assembly comprised of an electron emitter produced by the process of this invention, an anode spaced apart from the cathode assembly, the anode including a layer of a patterned optically transparent conductive film upon a cathode-facing surface of an anode support plate, and a layer of a phosphor capable of emitting light upon bombardment by electrons emitted by the electron emitter of the cathode assembly, the phosphor layer situated adjacent the layer of patterned optically transparent conductive film between the anode and cathode, and a gate electrode situated between the anode and the cathode, the gate electrode including a structure of conductive paths arranged substantially orthogonal to the patterned optically transparent conductive film, each conductive path selectively operably connected to an electron source, and a voltage source connected between the anode and electron emitter. In addition to the single gate electrode in the above-described triode structure, additional controlling electrodes can be used; their use can allow lower emission voltages on the gate electrode and provide higher acceleration voltages. These additional electrodes also provide a means to adjust the field pattern and the emission and to focus the emitted electrons.

BRIEF DESCRIPTION OF THE DRAWINGS

FIG. 6 shows scanning electron micrographs for the sample of Example 6 before and after ion beam bombardment.

DETAILED DESCRIPTION OF THE PREFERRED EMBODIMENTS

Figure 1:
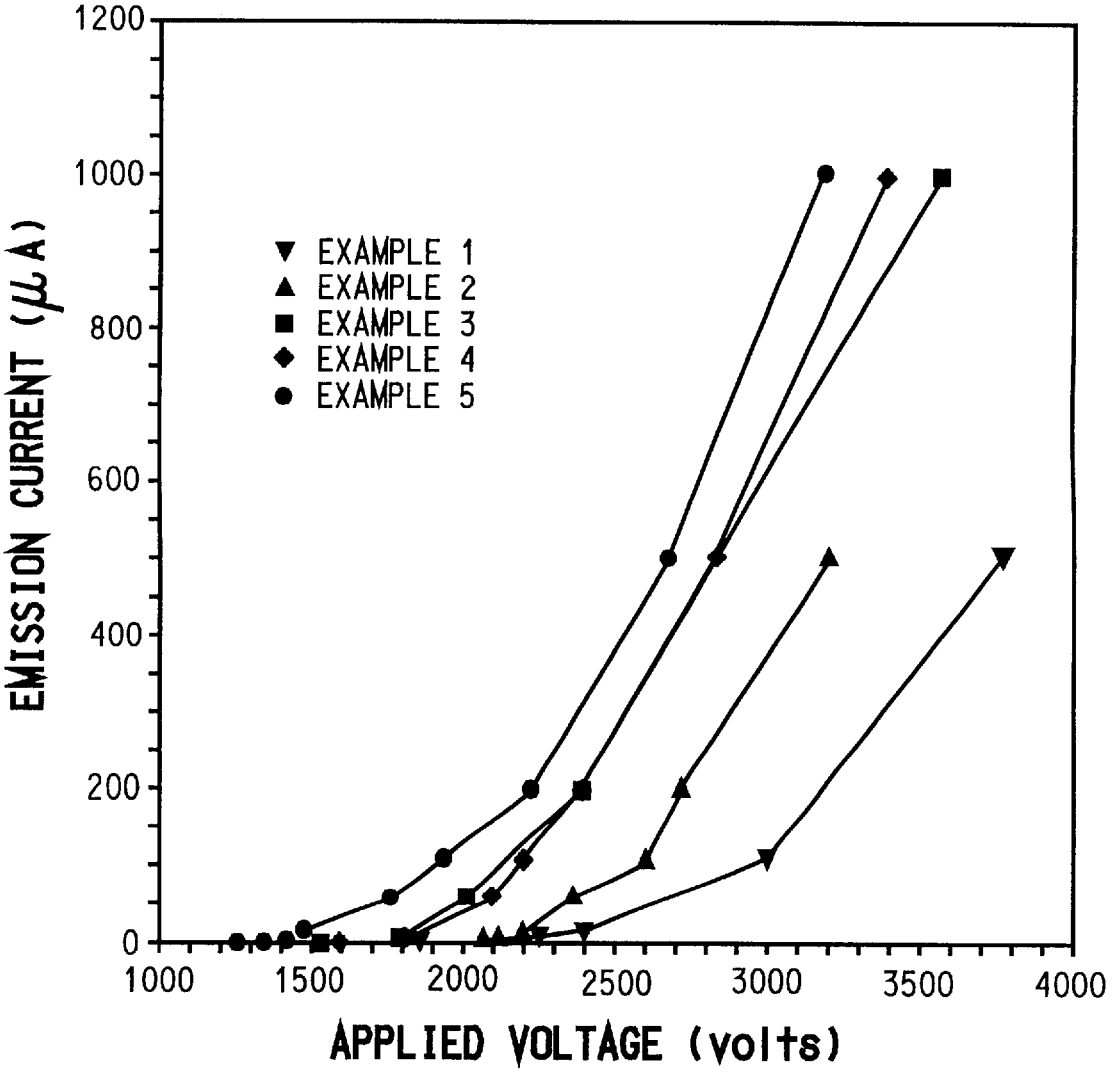
FIG. 1 shows the emission results for the electron emitters of Examples 1–5 with emission current plotted as a function of applied voltage.

The process of the invention for producing a field emission electron emitter comprises forming a layer of composite which comprises graphite particles and glass on a substrate. The glass adheres to the substrate and to portions of the graphite particles, thereby affixing the graphite particles to one another and to the substrate. Glass is superior to organic polymeric adhesives because of the extremely aggressive environment during the bakeout and sealing operations which are necessary for making an emission device. Typical bakeout conditions are 450° C. and a high vacuum. This is followed by a sealing operation which permanently isolates the device from any atmospheric contamination. In addition, the presence of residual organics as part of the device components will lead to arcing under the high electrical fields present during field emission and to the lowering of the high vacuum which is critical for the operation of a field emission device. No existing organic adhesive can withstand such conditions. In contrast, glass is impervious to these conditions. It is desirable to have as much of the surface area of the layer of composite as possible consist of portions of graphite particles and to have the portions of the graphite particles at the surface of the layer of composite be free of glass. The process of this invention provides a layer of composite wherein at least 50% of the surface area of the layer of composite consists of portions of graphite particles. The composite can further comprise electrically conducting material, in which case the graphite and the electrically conducting material adhere to the substrate, to each other and to the graphite particles.

As used herein, "graphite particles" means the particles of the usual hexagonal graphite, both synthetic and natural forms.

Various processes can be used to form a layer of composite which comprises graphite particles and glass on a substrate, but the preferred process is to screen print a paste comprised of graphite particles and glass frit onto a substrate in a desired pattern and to then fire the dried patterned paste. For a wider variety of applications, e.g., those requiring finer resolution, the preferred process comprises screen printing a paste which further comprises a photoinitiator and a photohardenable monomer, photo-patterning the dried paste, developing and firing the patterned dried paste.

The substrate can be any material to which the glass in the layer of composite will adhere. Silicon, a glass, a metal or a refractory material such as alumina can serve as the substrate. Non-conducting materials will require a layer of an electrical conductor to serve as the cathode electrode and provide means to apply a voltage to and supply electrons to the graphite particles.

As used herein, "substrate" means the structure on which the layer of composite is formed, either a single material or a combination of materials, e.g., a non-conducting material such as glass with a layer of an electrical conductor. A preferred technique for providing such an electrically conducting layer is to form a conducting composite by screen printing and firing a silver or gold conductor composition.

When screen printing or photopatterning is used to form a layer of composite, the preferable substrate comprises glass and soda lime glass is especially preferred.

The paste used for screen printing typically contains graphite particles, low softening point glass frit, an organic medium, solvent and surfactant. The role of the medium and solvent is to suspend and disperse the particulate constituents, i.e., the solids, in the paste with a proper rheology for typical patterning processes such as screen printing. There are a large number of such mediums known in the art. Examples of resins that can be used are cellulosic resins such as ethyl cellulose and alkyd resins of various molecular weights. Butyl carbitol, butyl carbitol acetate, dibutyl carbitol, dibutyl phthalate and terpineol are examples of useful solvents. These and other solvents are formulated to obtain the desired viscosity and volatility requirements A surfactant can be used to improve the dispersion of the particles. Organic acids such oleic and stearic acids and organic phosphates such as lecithin or Gafac® phosphates are typical surfactants. A glass frit that softens sufficiently at the firing temperature to adhere to the substrate and to the graphite particles is required. A lead glass frit has been used in some of the Examples but other glasses with low softening points as calcium or zinc borosilicates can be used and the use of a bismuth-zinc-alumino-borosilicate has been demonstrated in other Examples. The use of Pb-free glass frit is preferred. Preferably, the graphite particles have at least dimensions of 1 $\mu$m. If a layer of composite with higher electrical conductivity is desired, the paste also contains a metal such as silver or gold. The paste typically contains about 40 wt % to about 60 wt % solids based on the total weight of the paste. These solids comprise graphite particles and glass frit or graphite particles, glass frit and metal. The volume percent of graphite particles is about 35% to about 80% of the total volume of the solids. Variations in the composition can be used to adjust the viscosity and the final thickness of the printed material.

The paste is typically prepared by milling a mixture of graphite particles, low softening point glass frit, organic medium, surfactant and a solvent. The paste mixture can be screen printed using well-known screen printing techniques, e.g. by using a 165–400-mesh stainless steel screen. The paste is deposited in the form of a desired pattern, e.g., discrete elements, interconnected areas or a continuous film. The screen-printed paste is dried before firing, typically by heating at 125° C. for about 10 minutes. When the substrate comprises glass, the dried paste is then fired at a temperature of about 450° C. to about 575° C., preferably from about 475° C. to about 525° C., for about 10 minutes. Higher firing temperatures can be used with substrates which can endure them. Paste fired at a temperature of about 450° C. to about 500° C. results in a field emission electron emitter with lower turn-on voltage and lower voltage for a given emission current than paste fired at 525° C. However, with the glass frit used in the Examples, a layer of composite produced by firing at 525° C. shows better adhesion to the substrate than those fired at lower temperatures. Glass frits which soften at lower temperatures can be used in the paste to provide better adherence for paste fired at 450° C. to 500° C. and to thereby take advantage of the better emission properties of the composites produced at these lower firing temperatures. It is during this firing step that the organic materials are volatilized leaving the layer of composite comprised of graphite particles and glass. Surprisingly, the graphite particles undergo no appreciable oxidation or other chemical or physical change during the firing.

If the screen-printed paste is to be photopatterned, the paste contains a photoinitiator and a photohardenable monomer comprised, for example, of at least one addition polymerizable ethylenically unsaturated compound having at least one polymerizable ethylenic group.

Scanning electron micrographs (SEM) of the fired material show that the graphite particles make up a large portion of the surface area of the layer of composite. Typically, 80% or more of the surface area is comprised of portions of graphite particles.

The layer of deposited paste decreases in thickness upon firing. Preferably, the thickness of the fired layer of composite is from about 5 $\mu$m to about 30 $\mu$m.

The layer of composite which comprises graphite particles and glass on a substrate can be subsequently treated to produce a field emission electron emitter. For example, the layer of composite is then subjected to ion beam bombardment under the following conditions. Beams of argon, neon, krypton or xenon ions can be used. Argon ions are preferred. Reactive gases, such as nitrogen and oxygen, can be added to the argon gas to lower the voltage for turn-on, the onset of emission, and the voltage for producing an emission current of 1 mA. For both nitrogen and oxygen, the preferred amount of substitution is preferably from about 8% to about 15%, i.e., the preferred, compositions of the gases used in the ion bombardment are from about 92% Ar/8% $N_2$ to about 85% Ar/15% $N_2$ and from about 92% Ar/8% $O_2$ to about 85% Ar/15% $O_2$. The compositions 90% Ar/10% $N_2$ and 90% Ar/10% $O_2$ are especially preferred. All gas percentages are by volume. For the same percentage of substitution, nitrogen is more effective than oxygen in lowering the voltages required for emission. Oxygen ions are more chemically active and produce volatile species like CO and $CO_2$. This results in a faster etch but the finer whiskers are also consumed in the process. Nitrogen ions are not as reactive and the reaction products are not volatile.

The pressure during bombardment is about $0.5\times10^{-4}$ torr ($0.7\times10^{-2}$ Pa) to about $5\times10^{-4}$ torr ($6.7\times10^{-2}$ Pa), preferably from about $1.0\times10^{-4}$ torr ($1.3\times10^{-2}$ Pa) to about $2\times10^{-4}$ torr ($2.7\times10^{-2}$ Pa), The ion beam bombardment is carried out at ion current densities of about 0.1 mA/cm$^2$ to about 1.5 mA/cm$^2$, preferably about 0.5 mA/cm$^2$ to about 1.2 mA/cm$^2$, with beam energies of about 0.5 keV to about 2.5 keV, preferably about 1.0 keV to about 1.5 keV. Bombardment times of about 10 minutes to 90 minutes or more can be used. Under these conditions, whiskers and cones are formed on the graphite particle surfaces and the resulting product is a good field emission electron emitter. Ranges of the exposure times and optimal exposure times depend on the other bombardment conditions and the thickness of the layer of composite. Bombardment must be for a time sufficient to result in the formation of the whiskers and cones on the graphite particles but not so long that portions of the layer of composite are etched through to the substrate since this results in a degradation of emission properties. To avoid this occurrence but still have sufficient bombardment time to result in the formation of the whiskers and cones on the graphite particles, it is more preferable for the thickness of the fired layer of composite to be from about 7 $\mu$m to about 30 $\mu$m and most preferable for the thickness of the fired layer of composite to be from about 10 $\mu$m to about 30 $\mu$m. Bombardment times of longer than about 60 minutes require very thick samples. Bombardment times of about 15 minutes to about 60 minutes are preferred for layers of composite with the preferred thicknesses and bombardment times of about 40 minutes to about 50 minutes are especially preferred.

When the layer of composite does not cover the entire substrate, portions of the surface that would be exposed to the ion beam would be substrate material. For example, when the layer of composite is not a continuous film but rather a pattern of discrete elements or interconnected areas, portions of the substrate would be exposed to the ion beam. When the substrate consists of a non-conducting material such as glass with a layer of an electrical conductor, portions of the glass and/or the electrical conductor would be exposed to the ion beam. Even when the layer of composite is in the form of a continuous layer, there may be portions of the substrate, e.g., the glass and/or electrical conductor, surrounding the layer of composite that would be exposed to the ion beam. In another instance, in order to provide discrete areas of a continuous layer of composite which can serve as areas of good electron emission separated by regions having greatly reduced emission, it is necessary to prevent portions of the continuous layer of composite from being exposed to the ion beam. In all these instances, it is preferred to mask any portions of the substrate that would otherwise be exposed to the ion beam and any desired portions of the layer of composite that are not to be exposed to the ion beam. The use of such a mask is preferred in order to consistently produce the desired electron matter. Especially preferred is a graphite mask.

Any ion source can be used. Currently, Kaufmann Ion Sources are the most readily available commercially.

The surface structure of the graphite particles changes significantly during the ion bombardment step. As a result of etching, it is no longer smooth, but instead becomes textured and comprised of cones. Diameters of the cones range from about 0.1 $\mu$m to about 0.5 $\mu$m. The cones develop in the direction toward the incident ion beam so that when ion beam etching is carried out at angles other than 90° (i.e., normal to the surface), the cones are not normal to the surface. The graphite etches uniformly over the area bombarded, i.e., the density of the cones (the number of cones per unit area) and the appearance of the cones is uniform.

Transmission electron micrographs (TEM) of the cones formed indicate that they consist of small grains of crystalline carbon. On the periphery of the cone there appears to be a shell of ordered carbon material with a thickness the order of 10 nm. The graphene planes in this shell are ordered perpendicular to the growth direction of the cone. A cone is believed to be that part of the original graphite surface which is left behind following ion beam etching.

In addition to the cones, whiskers are also formed during ion bombardment of the graphite particle surfaces. Whiskers are typically located at the tips of the cones. The lengths of the whiskers can extend from 2 $\mu$m to distances of 20 $\mu$m or more. The lengths of the whiskers can be much greater than the initial dimensions of the graphite particles. Diameters of the whiskers are in the range of 0.5 to 50 nm. The whiskers form in the direction toward the incident ion beam. The whiskers are flexible, and they have been observed to move during scanning electron microscopy (SEM) measurements.

The angle of incidence of the ion beam can be varied. As used herein, angle of incidence is defined as the angle between the incident ion beam and the plane of the layer of composite. The emission characteristics do not vary markedly with changes in the incident angle from 90° (i.e., normal to the plane) to 45°. However, the structure is greatly affected by the angle of incidence because, as described above, the cones and whiskers typically grow in the direction of the incident ion beam. For use as an emitter in a typical triode device, a 90° angle of incidence is preferred since that results in the cones and whiskers being formed perpendicular to the plane of the layer of composite.

For the Examples that follow, a 3 cm-diameter ion gun (Kauffman Ion Source, Model II) was used to create an argon, argon and nitrogen, or argon and oxygen ion beam of about 2 inches diameter (5 cm) at the sample surface. This is a turbo-pumped system with a base pressure of $1\times10^{-8}$ torr ($1.3\times10^{-6}$ Pa). After the base pressure is reached, the working gas, argon, argon and nitrogen, or argon and oxygen, is fed into the system through a needle valve until a steady working pressure of $1\times10^{-4}$ torr ($1.3\times10^{-2}$ Pa) was achieved. The distance between the ion gun and the surface is 4–5 inches (10–12.5 cm).

Transmission electron micrographs of the carbon whiskers indicate that they are solid and consist of amorphous carbon. This material is believed to be carbon which has been removed from the original graphite particles by ion beam etching and then redeposited, initially typically at the tips of cones and then at the tips of the growing whiskers. Alternately, the whiskers may form by carbon activated by the ion beam which diffuses to the tips of the cones or whiskers. Carbon whiskers differ in structure from carbon nanotubes, Carbon nanotubes are hollow and contain shells of graphite-like sheets of carbon. Carbon whiskers are solid and exhibit no long range crystalline order in any direction.

Ion beam bombardment can be avoided if the carbon is provided in the paste in the form of small whiskers. This can be accomplished by substituting carbon nanotubes for the graphite particles in the paste. Especially preferred are single wall carbon nanotubes. The individual single wall carbon nanotubes are extremely small, typically about 1.5 nm in diameter and exist in the form of ropes which loop around in 3 dimensions. The carbon nanotubes are sometimes described as graphite-like, presumably because of the $sp^2$ hybridized carbon. The wall of a carbon nanotube can be envisioned as a cylinder formed by rolling up a graphene sheet.

Mats formed from carbon nanotubes are extremely effective electron emitters. All of the disclosure regarding the formulation and characteristics of the paste and the printing of the paste when graphite particles are used is equally valid when carbon nanotubes are used in place of graphite particles. The paste containing the carbon nanotubes is prepared, screen printed and fired following the description above and in the Examples. The desired pattern can be obtained directly by screen printing or by photopatterning the screen-printed paste. The resulting layer of composite which comprises carbon nanotubes and glass is an effective field emission electron emitter and further treatment, e.g., ion bombardment is not necessary.

Field emission tests were carried out in the Examples using a flat-plate emission measurement unit comprised of two electrodes, one serving as the anode or collector and the other serving as the cathode. The unit was comprised of two square copper plates, 1.5 in by 1.5 in (3.8 cm×3.8 cm), with all corners and edges rounded to minimize electrical arcing. Each copper plate was embedded in a separate polytetrafluoroethylene (PTFE) block, 2.5 in×2.5 in (4.3 cm×4.3 cm), with one 1.5 in by 1.5 in (3.8 cm×3.8 cm) copper plate surface exposed on the front side of the PTFE block. Electrical contact to the copper plate was made by a metal screw through the back of the PTFE block and extending into the copper plate, thereby providing a means to apply an electrical voltage to the plate and means to hold the copper plate firmly in place. The two PTFE blocks were positioned with the two exposed copper plate surfaces facing one another and in register with the distance between the plates fixed by means of glass spacers placed between the PTFE blocks but distanced from the copper plates to avoid surface leakage currents or arcing. The separation distance between the electrodes can be adjusted, but once chosen, it was fixed for a given set of measurements on a sample. Typically, separations of 0.5 mm to about 2 mm were used.

The sample was placed on the copper plate serving as the cathode. In the case of a conducting substrate, a sample can be held in place and electrical contact made by applying a small drop of carbon paint to the back of the sample and allowing it to dry. In the case of an insulating substrate with a conducting film, the substrate was held down on two sides with conducting copper tape, which also served to provide for electrical contact.

The test apparatus was inserted into a vacuum system, and the system was evacuated to a base pressure below $5\times10^{-6}$ torr ($6.7\times10^{-4}$ Pa). A negative voltage was applied to the cathode and the emission current was measured as a function of the applied voltage. The separation distance between the plates was measured.

The particle size characteristic $d_{50}$ is the particle size such that the weight of all smaller size particles equals the weight of all larger size particles. The $d_{50}$ reported herein have been determined using Microtrak® equipment.

Fineness-of-grind (fineness-of-dispersion) is measured using a Hegman-type gage. This method provides a rapid, visual measure to assess the degree of dispersion and agglomeration of the solid particles in the paste. The gage used consists of a steel block in which is cut a flat channel with a v-shaped cross-section tapering from 25 μm at the deep end to zero at the other end. Enough paste is placed in the deep end of the channel to fill it and it is drawn toward the shallow end with a doctor blade. At some point along the channel larger particles or agglomerates will become visible. The surface of the paste then becomes scratched reflecting the presence of the agglomerates. For the purposes herein, the depth of the channel at the fourth scratch is recorded as a first measure of the fineness-of-grind. The depth of the channel by which 50% of area has become covered with scratches is recorded as the second measure and the fineness-of-grind is reported as the first measure/second measure.

EXAMPLES OF THE INVENTION

The following non-limiting Examples are intended to further enable and describe the invention.

All parts and percentages are by weight unless otherwise specified. The materials used in forming the pastes are:

Graphite Particles I: Natural HPN-10 graphite powder—$d_{50}$=8 μm, surface area=8.6 $m^2/g$ Graphite Particles II: Natural flake—Asbury Carbon, Inc., $d_{50}$=3–5 μm, surface area=13 $m^2/g$ Graphite Particles III: Synthetic UF 440—Asbury Carbon, Inc., $d_{50}$Å 1 μm, surface area=85 $m^2/g$ Glass I: 1.6% $SiO_2$, 1.7% $Al_2O_3$, 85.8% PbO, 10.9% $B_2O_3$ Glass II: 2.00% $SiO_2$, 2.98% $Al_2O_3$, 13.20% $B_2O_3$, 8.99% ZnO, 0.96 $Na_2O$, 71.87% $Bi_2O_3$ Organic Medium I: 10% N-22 ethyl cellulose, 30% diethyleneglycol, 30% dibutyl ether and 30% β-terpineol Organic Medium II: 13% P-50 ethyl cellulose and 87% β-terpineol Organic Medium III: 10% N-22 ethyl cellulose and 90% β-terpineol Surfactant: soya lecithin Solvent: β-terpineol All heatings were carried out in laboratory-type heating ovens with temperature uncertainties of ±10° C.

Examples 1–5

Electron emitters were prepared in each of these Examples using the following procedure.

In each of these Examples a paste comprised of graphite particles and glass frit was screen printed onto a glass substrate and fired to form a layer of composite which comprises graphite particles and glass. These Examples show the effect of different amounts of graphite on electron emission.

Forty gram samples of paste used in Examples 1 and 5 were prepared by mixing the materials shown in Table 1 in the percentages shown. Each mixture was roll milled using a three roll mill at a roll pressure of 100/200 psi ($6.9/13.8\times10^5$ Pa).

TABLE 1

| | Graphite Particles I | Glass I | Organic Medium I | Organic Medium II | Organic Medium III | Surfactant | Solvent |
|---|---|---|---|---|---|---|---|
| Example 1 | 8.3 | 41.7 | 0 | 10 | 39 | 1 | 0 |
| Example 5 | 25 | 25 | 37 | 0 | 0 | 3 | 10 |

Pastes for Examples 2, 3 and 4 were prepared by mixing portions of the pastes prepared for Examples 1 and 5 in the ratio of 3:1, 1:1 and 1:3, respectively. The percentages of graphite particles in the pastes used in Examples 1–5 were 8.3%, 12.5%, 16.7%, 20.8% and 25%, respectively. The total percentage of solids, i.e., graphite particles and glass frit, in the paste was 50% in all of these Examples. On the basis of the total volume of the graphite particles and the glass frit, the volume per cent of graphite particles varied from 37% for the paste of Example 1 to 74% for the paste of Example 5. The paste of each Example was applied to a glass slide in a 1 inch (2.5 cm) square pattern using a 200 mesh screen. The dried paste was then fired in air by increasing the temperature at a rate of 20° C. per minute to a temperature of 525° C., maintaining the temperature at 525° C. for 10 minutes, and then cooling to ambient temperature by decreasing the temperature at a rate of 20° C. per minute. The thickness of the fired layer of composite was about 20 μm. The result was the formation of a layer of composite which comprises graphite particles and glass on a substrate.

Scanning electron micrographs (SEM) of the fired material show that the graphite particles make up a large portion of the surface area of the layer of composite and little glass is evident.

For each sample, a mask was used to expose a 1 cm×1 cm area of the 1 inch×1 inch (2.5 cm×2.5 cm) sample and the surface area of the layer of composite in the exposed region was subjected to argon ion beam bombardment under the following conditions: ion beam made a 90° angle of incidence with the plane of the sample, i.e., was normal to the surface of the layer of composite, beam current of 10 mA, beam voltage of 1.4 kV, ion beam gun-sample distance of 4 inches (10 cm), beam diameter at sample of 2 inches (5 cm), argon partial pressure of $1\times10^{-4}$ torr ($1.3\times10^{-2}$ Pa), and exposure time of 45 minutes. Following the ion beam bombardment, scanning electron micrography showed that the surfaces of the graphite particles were comprised of carbon cones normal to the surface with carbon whiskers at the tips of the carbon cones also normal to the surface, i.e., in the direction of the incident ion beam.

Emission results from the 1 cm×1 cm area, which had been ion bombarded, were obtained by placing the glass slide containing the screen printed ion-bombarded graphite particles on the copper block cathode of the measurement unit described above. Two pieces of conducting copper tape were applied at each side of the substrate both to hold the substrate in place and to provide electrical contact to the screen printed sample. The separation distance of the surface of the screen printed sample and the copper block anode was 0.6 mm. The system was evacuated to a base pressure of below $5\times10^{-6}$ torr ($6.7\times10^{-4}$ Pa). The voltage was increased until the emission current reached 500 $\mu$A for Examples 1 and 2 and 1000 $\mu$A for Examples 3–5.

Figure 2:
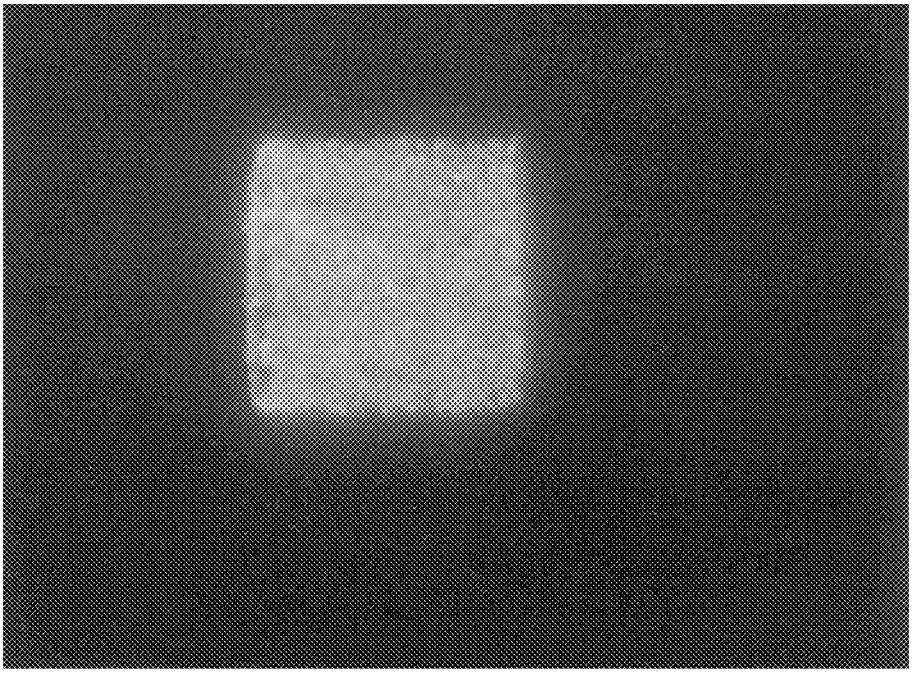
FIG. 2 is a photograph of the light emitted from a phosphor layer impinged by electron emission from the electron emitter of Example 4.

The emission results for the electron emitters of Examples 1–5 are plotted in FIG. 1. They show that the electron emitter of Example 5 with the highest graphite content shows the highest emission at a given applied voltage. The uniformity of emission over the whole 1 cm×1 cm area was confirmed by using an anode consisting of glass coated with indium tin oxide with a layer of phosphor superimposed on the indium tin oxide, having the emitted electrons impinge on the layer of phosphor and observing:the resultant light emitted from the phosphor. The result obtained from the electron emitter of Example 4 is shown in the photograph in FIG. 2.

Examples 6–8

Electron emitters were prepared in each of these Examples using the following procedure.

In each of these Examples a paste comprised of graphite particles and glass frit was screen printed onto a glass substrate and fired to form a layer of composite which comprises graphite particles and glass. These Examples show the effect of the use of three different graphites on electron emission.

Samples of paste used in Examples 6–8 were prepared by mixing the materials shown in Table 2 in the percentages shown. In each Example, 25% of the type of graphite particles indicated was used. Each mixture was roll milled using a three roll mill at a roll pressure of 100/200 psi ($6.9/13.8\times10^5$ Pa).

Scanning electron micrographs (SEM) of the fired material show that the graphite particles make up a large portion of the surface area of the layer of composite.

For each sample, a mask was used to expose a 1 cm×1 cm area of the 1 inch (2.5 cm)×1 inch (2.5 cm) sample and the surface area of the layer of composite in the exposed region was subjected to argon ion beam bombardment under the following conditions: ion beam made a 90° angle of incidence with the plane of the sample, i.e., was normal to the surface of the layer of composite, beam current of 10 mA, beam voltage of 1.4 kV, ion beam gun-sample distance of 4 inches (10 cm), beam diameter at sample of 2 inches (5 cm), argon partial pressure of $1\times10^{-4}$ torr ($1.3\times10^{-2}$ Pa), and exposure time of 45 minutes. Following the ion beam bombardment, scanning electron micrography showed that the surfaces of the graphite particles were comprised of carbon cones normal to the surface with carbon whiskers at the tips of the carbon cones also normal to the surface, i.e., in the direction of the incident ion beam.

FIG. 6 (*a*) is the SEM for the sample of Example 6 before ion beam bombardment and FIG. 6 (*b*) is the SEM for the sample of Example 6 after ion beam bombardment. These pictures clearly show the absence of cones and whiskers before the ion beam bombardment and their presence after ion beam bombardment.

Emission results from the 1 cm×1 cm area which had been ion bombarded were obtained by placing the glass slide containing the screen printed ion-bombarded graphite particles on the copper block cathode of the measurement unit described above. Two pieces of conducting copper tape were applied at each side of the substrate both to hold the substrate in place and to provide electrical contact to the screen printed sample. The separation distance of the surface of the screen printed sample and the copper block anode was 0.6 mm. The system was evacuated to a base pressure of below $5\times10^{-6}$ torr ($6.7\times10^{-4}$ Pa). The emission current was measured as a function of voltage. The voltage was increased until the emission current reached 1000 $\mu$A.

Figure 3:
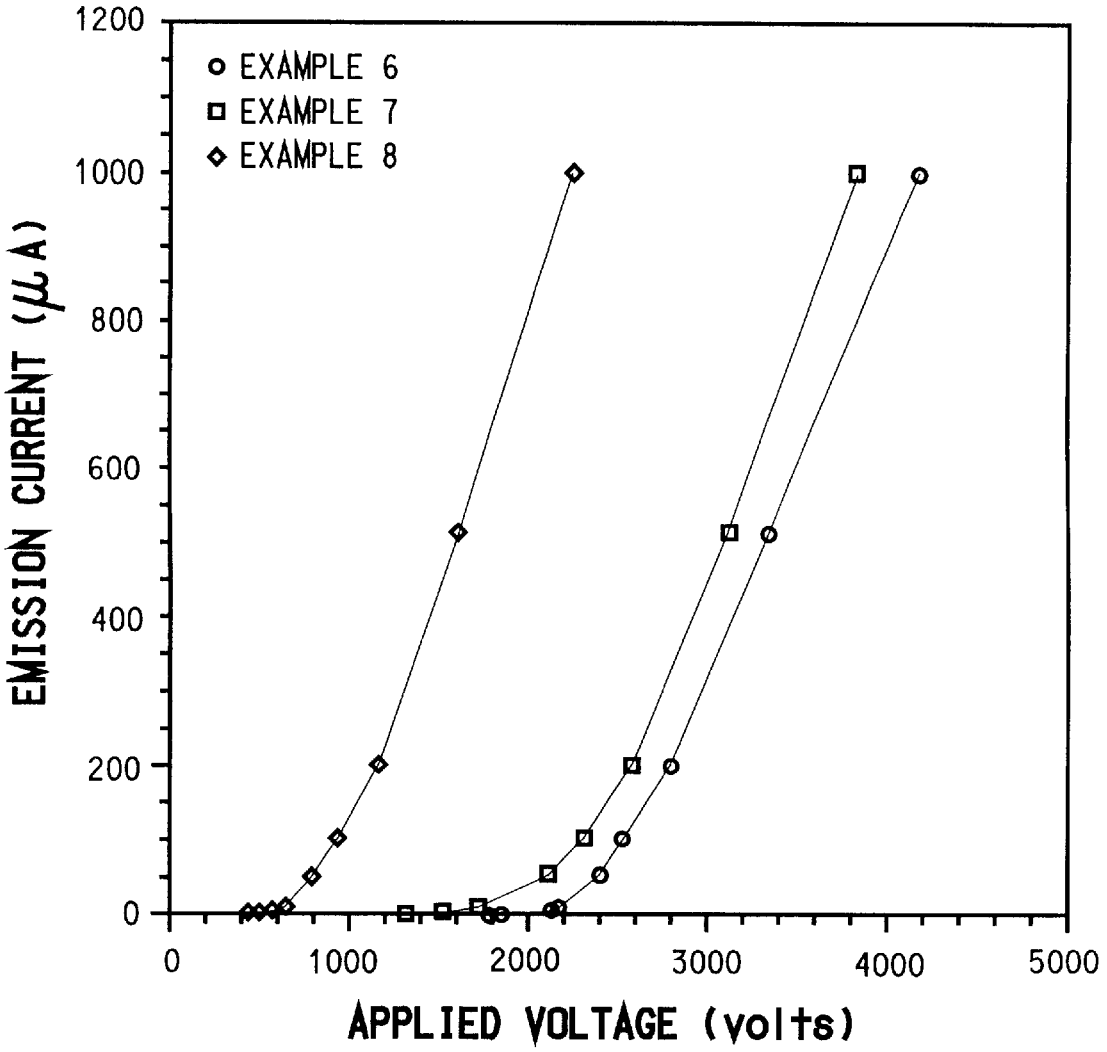
FIG. 3 shows the emission:results for the electron emitters of Examples 6–8 with emission current plotted as a function of applied voltage.

The emission results for the electron emitters of Examples 6–8 are plotted in FIG. 3. The electron emitter of Example 8 made with the Graphite Particles III, i.e., the graphite particles having the highest surface area, shows the highest emission at a given applied voltage.

Examples 9–12

Electron emitters were prepared in each of these Examples using the following procedure.

TABLE 2

| | Graphite Particles Used | Graphite Particles | Glass I | Organic Medium I | Organic Medium II | Surfactant | Solvent |
|---|---|---|---|---|---|---|---|
| Example 6 | I | 25 | 25 | 37 | 0 | 3 | 10 |
| Example 7 | II | 25 | 25 | 16 | 22 | 2 | 10 |
| Example 8 | III | 25 | 25 | 13 | 25 | 2 | 10 |

The paste of each Example was applied to a glass slide in a 1 inch (2.5 cm) square pattern using a 200 mesh screen. The dried paste was then fired in air by increasing the temperature at a rate of 20° C. per minute to a temperature of 525° C., maintaining the temperature at 525° C. for 10 minutes, and then cooling to ambient temperature by decreasing the temperature at a rate of 20° C. per minute. The thickness of the fired layer of composite was about 20 $\mu$m. The result was the formation of a layer of composite which comprises graphite particles and glass on a substrate.

In each of these Examples a paste comprised of graphite particles and glass frit was screen printed onto a glass substrate and fired to form a layer of composite which comprises graphite particles and glass. These Examples show the effect of the fineness-of-grind of the solids used in the paste on electron emission.

A 40 g sample of paste was prepared by mixing the materials shown in Table 3 in the percentages shown.

TABLE 3

| Graphite Particles I | Glass I | Organic Medium I | Organic Medium II | Surfactant | Solvent |
|---|---|---|---|---|---|
| 25 | 25 | 21 | 17 | 2 | 10 |

The mixture was divided into 4 samples. These 4 samples were roll milled using a three roll mill at roll pressures of 100, 150, 200 and 250 psi (6.9, 10.3, 13.8 and $17.3\times10^5$ Pa) respectively for the samples of Examples 9–12. A portion of each sample was used to determine the fineness-of-grind as described above. The characterization for each of the samples of Examples 9–12 was 17/15, 9/7, 5/4 and 4/3, respectively.

The paste of each Example was applied to a glass slide in a 1 inch (2.5 cm) square pattern using a 200 mesh screen. The dried paste was then fired in air by increasing the temperature at a rate of 20° C. per minute to a temperature of 525° C., maintaining the temperature at 525° C. for 10 minutes, and then cooling to ambient temperature by decreasing the temperature at a rate of 20° C. per minute. The thickness of the layer of composite after firing was 27, 25, 21 and 16 $\mu$m respectively for the layers of Examples 9–12. The result was the formation of a layer of composite which comprises graphite particles and glass on a substrate.

Figure 4A:
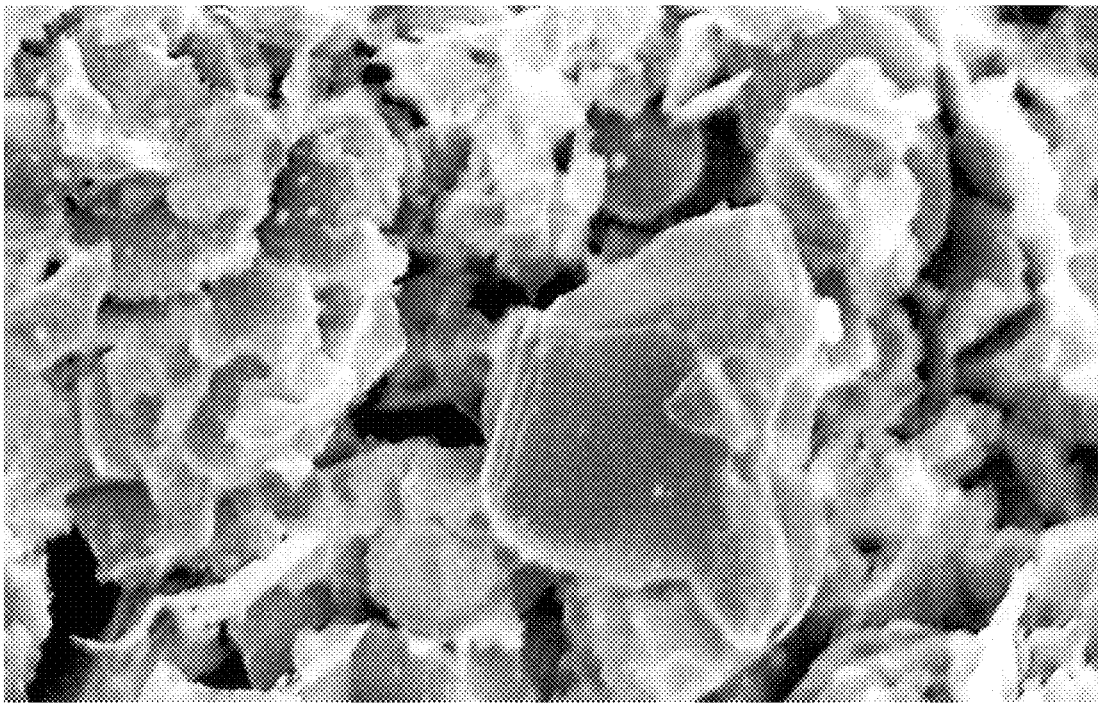
FIG. 4 shows scanning electron micrographs for the sample of Example 9 before ion beam bombardment for two different magnifications.
Figure 4B:
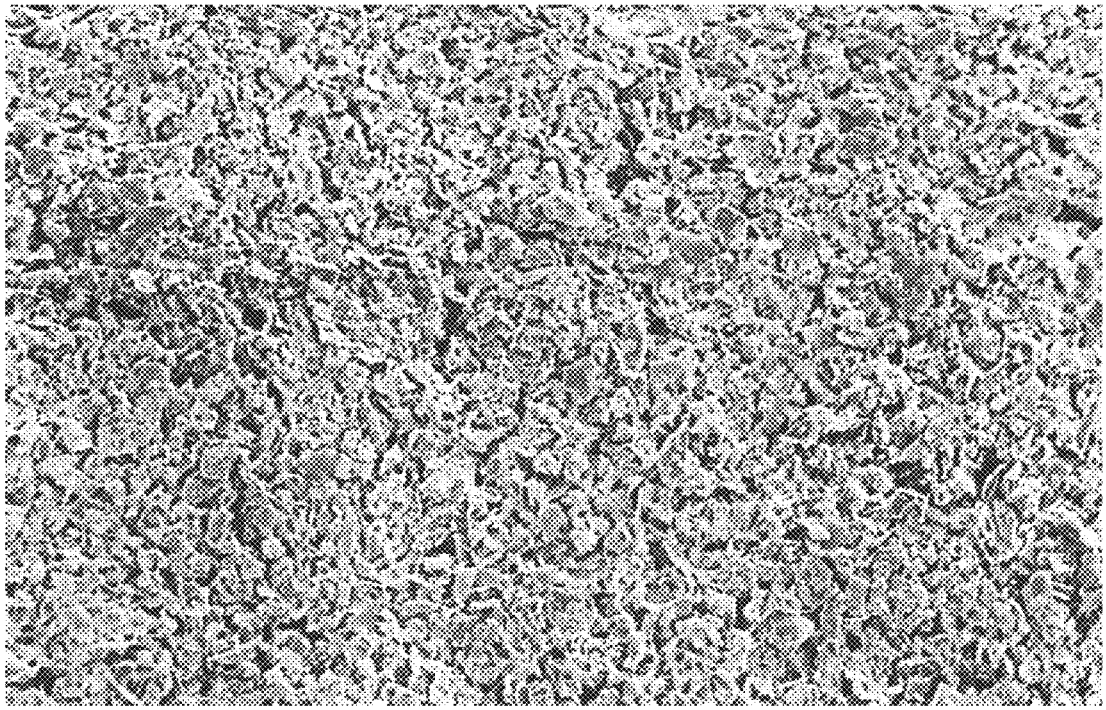

Scanning electron micrographs (SEM) of the fired material show that the graphite particles make up a large portion of the surface area of the layer of composite. FIG. 4 is the SEM for the sample of Example 9 for two different magnifications and shows that the surface of the composite consists almost entirely of graphite particles.

For each sample, a mask was used to expose a 1 cm×1 cm area of the 1 inch×1 inch (2.5 cm×2.5 cm) sample and the surface area of the layer of composite in the exposed region was subjected to argon ion beam bombardment under the following conditions: ion beam made a 90° angle of incidence with the plane of the sample, i.e., was normal to the surface of the layer of composite, beam current of 10 mA, beam voltage of 1.4 kV, ion beam gun-sample distance of 4 inches (10 cm), beam diameter at sample of 2 inches (5 cm), argon partial pressure of $1\times10^{-4}$ torr ($1.3\times10^{-2}$ Pa), and exposure time of 45 minutes. Following the ion beam bombardment, scanning electron micrography showed that the surfaces of the graphite particles were comprised of carbon cones normal to the surface with carbon whiskers at the tips of the carbon cones also normal to the surface, i.e., in the direction of the incident ion beam.

Emission results from the 1 cm×1 cm area which had been ion bombarded were obtained by placing the glass slide containing the screen printed ion-bombarded graphite particles on the copper block cathode of the measurement unit described above. Two pieces of conducting copper tape were applied at each side of the substrate both to hold the substrate in place and to provide electrical contact to the screen printed sample. The separation distance of the surface of the screen printed sample and the copper block anode was 0.6 mm. The system was evacuated to a base pressure of below $5\times10^{-6}$ torr ($6.7\times10^{-4}$ Pa). The emission current was measured as a function of voltage. The voltage was increased until the emission current reached 1000 $\mu$A.

Figure 5:
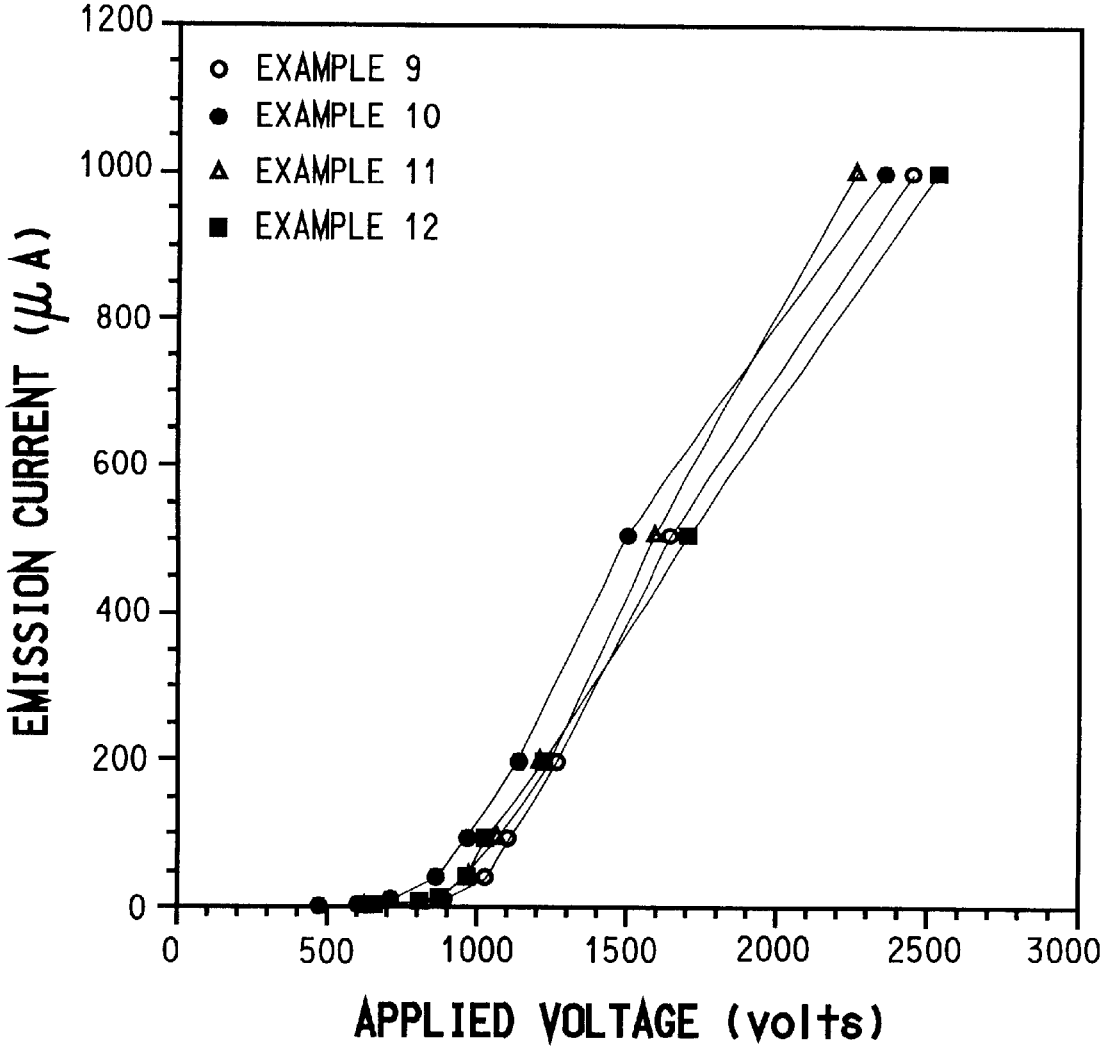
FIG. 5 shows the emission results for the electron emitters of Examples 9–13 with emission current plotted as a function of applied voltage.

The emission results for the electron emitters of Examples 9–12 are plotted in FIG. 5. Fineness-of-grind seems to have no effect on the emission results.

Examples 13–14

Electron emitters were prepared in each of these Examples using the following procedure.

In each of these Examples a paste comprised of graphite particles and Pb-free glass frit was screen printed onto a glass substrate and fired to form a layer of composite which comprises graphite particles and glass. These Examples show that Pb-free glass and different graphites can be used to obtain electron emission results similar to those obtained with Pb-containing glass.

Six gram samples of paste used in Examples 13 and 14 were prepared by mixing the materials shown in Table 4 in the percentages shown. Each mixture was roll milled using a three roll mill at a roll pressure of 300 psi ($20.7\times10^5$ Pa).

TABLE 4

| | Graphite Particles I | Graphite Particles III | Glass II | Organic Medium I | Organic Medium II | Surfactant | Solvent |
|---|---|---|---|---|---|---|---|
| Example 13 | 25 | 0 | 25 | 21 | 17 | 2 | 10 |
| Example 14 | 0 | 25 | 25 | 21 | 17 | 2 | 10 |

The total percentage of solids, i.e., graphite particles and glass frit, in the paste was 50% in both of the Examples. The paste of each Example was applied to a glass slide in a 1 inch (2.5 cm) square pattern using a 200 mesh screen. The dried paste was then fired in air by increasing the temperature at a rate of 20° C. per minute to a temperature of 525° C., maintaining the temperature at 525° C. for 10 minutes, and then cooling to ambient temperature by decreasing the temperature at a rate of 20° C. per minute. The result was the formation of a layer of composite which comprises graphite particles and glass on a substrate. The thickness of the fired layer of composite was 27.6 $\mu$m for the sample of Example 13 and 20.4 $\mu$m for the sample of Example 14.

For each sample, a mask was used to expose a 1 cm×1 cm area of the 1 inch×1 inch (2.5 cm×2.5 cm) sample and the surface area of the layer of composite in the exposed region was subjected to argon ion beam bombardment under the following conditions: ion beam made a 90° angle of incidence with the plane of the sample, i.e., was normal to the surface of the layer of composite, beam current of 10 mA, beam voltage of 1.4 kV, ion beam gun-sample distance of 4 inches (10 cm), beam diameter at sample of 2 inches (5 cm), argon partial pressure of $1.5\times10^{-4}$ torr ($2.0\times10^{-2}$ Pa), and exposure time of 45 minutes.

Emission results from the 1 cm×1 cm area which had been ion bombarded were obtained by placing the glass slide containing the screen printed ion-bombarded graphite particles on the copper block cathode of the measurement unit described above. Two pieces of conducting copper tape were applied at each side of the substrate both to hold the substrate in place and to provide electrical contact to the screen printed sample. The separation distance of the surface of the screen printed sample and the copper block anode was 0.6 mm. The system was evacuated to a base pressure of below $5\times10^{-6}$ torr ($6.7\times10^{-4}$ Pa). The emission current was measured as a function of voltage. The voltage was increased until the emission current reached 1000 $\mu$A.

Figure 7:
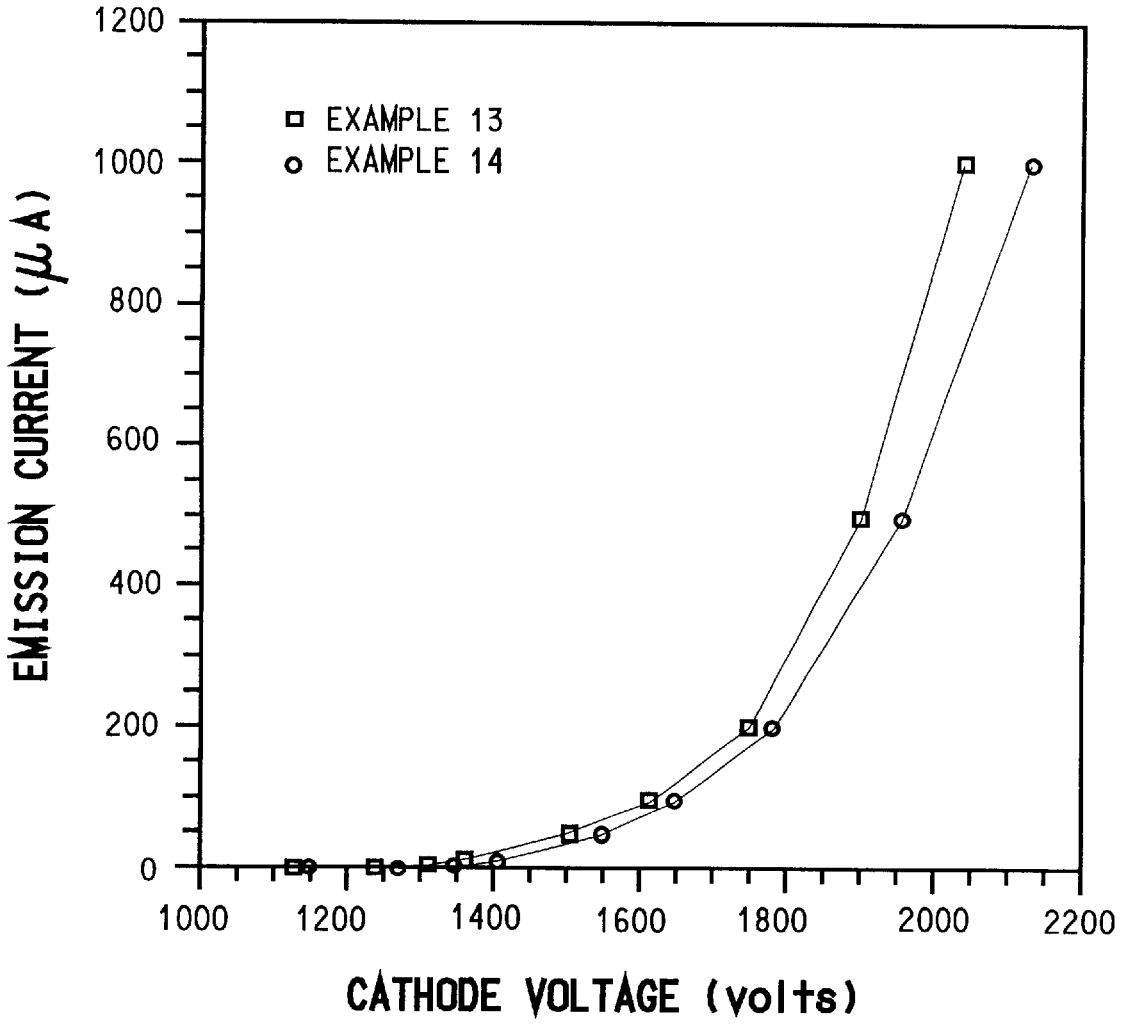
FIG. 7 shows the emission results for the electron emitters of Examples 13 and 14 with emission current plotted as a function of applied voltage.

The emission results for the electron emitters of Examples 13 and 14 are plotted in FIG. 7. There was no significant difference in the results obtained with the two different graphites.

Examples 15–21

Electron emitters were prepared in each of these Examples using the following procedure.

In each of these Examples a paste comprised of graphite particles and Pb-free glass frit was screen printed onto a substrate and fired to form a layer of composite which comprises graphite particles and glass. The substrate was comprised of a layer of silver conductor composition on a glass slide. These Examples show the effect of the composition of the ion beam on the emission properties of the electron emitters.

The substrate for each sample was made by screen printing a layer of silver conductor composition (DuPont #7095 Silver Conductor Composition, a screen printable thick film composition commercially available from E. I. du Pont de Nemours and Company, Wilmington, Del.) onto a 1 inch×1 inch (2.5 cm×2.5 cm) glass slide using a 200 mesh screen and firing the dried layer at a temperature of 525° C. for 10 minutes to produce a conducting silver composite layer.

A 40 g sample of paste was prepared by mixing the materials shown in Table 5 in the percentages shown. The mixture was roll milled using a three roll mill at a roll pressure of 300 psi ($20.7\times10^5$ Pa).

TABLE 5

| Graphite Particles III | Glass II | Organic Medium I | Organic Medium II | Surfactant | Solvent |
|---|---|---|---|---|---|
| 25 | 25 | 21 | 17 | 2 | 10 |

This paste was used to make seven samples, one for each of the Examples. Each sample was made by applying the paste to the silver composite layer on the glass slide using a 200 mesh screen. The dried paste was then fired in air by increasing the temperature at a rate of 20° C. per minute to a temperature of 525° C., maintaining the temperature at 525° C. for 10 minutes, and then cooling to ambient temperature by decreasing the temperature at a rate of 20° C. per minute. The result was the formation of a layer of composite which comprises graphite particles and glass on the silver composite layer/glass slide substrate.

For each sample, a mask was used to expose a 1 cm×1 cm area of the 1 inch×1 inch (2.5 cm×2.5 cm) sample and the surface area of the layer of graphite/glass composite in the exposed region was subjected to ion beam bombardment with different ion beam compositions. For Example 15, the gas used was 90% Ar/10% $O_2$; for Example 16, the gas used was 95% Ar/5% $O_2$; for Example 17, the gas used was 80% Ar/20% $O_2$; for Example 18, the gas used was 90% Ar/10% $N_2$; for Example 19, the gas was 95% Ar/5% $N_2$; for Example 20, the gas used was 80% Ar/20% $N_2$; and for Example 21, the gas used was 100% Ar. All gas percentages are by volume.

The following ion beam conditions were used for all these samples: ion beam made a 90° angle of incidence with the plane of the sample, i.e., was normal to the surface of the layer of composite, beam current of 10 mA, beam voltage of 1.4 kV, ion beam gun-sample distance of 4 inches (10 cm), beam diameter at sample of 2 inches (5 cm), partial pressure of $1.5\times10^{-4}$ torr ($2.0\times10^{-2}$ Pa), and exposure time of 45 minutes with the exception of Example 18 which had an exposure time of 50 minutes.

Emission results from the 1 cm×1 cm area which had been ion bombarded were obtained by placing the glass slide containing the screen printed ion-bombarded graphite particles on the copper block cathode of the measurement unit described above. Two pieces of conducting copper tape were applied at each side of the substrate both to hold the substrate in place and to provide electrical contact to the silver composite layer. The separation distance of the surface of the screen printed sample and the copper block anode was 0.6 mm. The system was evacuated to a base pressure of below $5\times10^{-6}$ torr ($6.7\times10^{-4}$ Pa). The emission current was measured as a function of voltage. The voltage was increased until the emission current reached 1000 $\mu$A.

Figure 8:
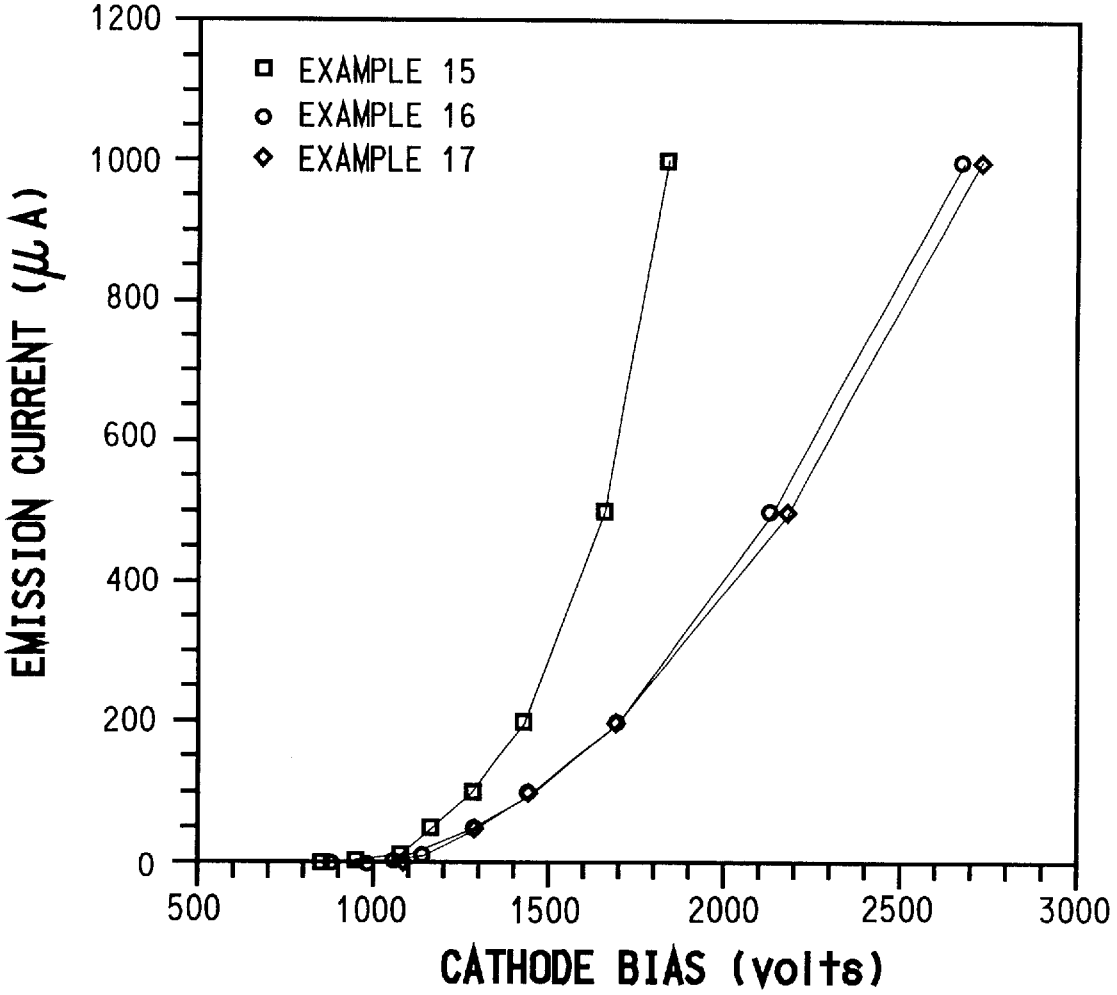
FIG. 8 shows the emission results for the electron emitters of Examples 15–17 with emission current plotted as a function of applied voltage.
Figure 9:
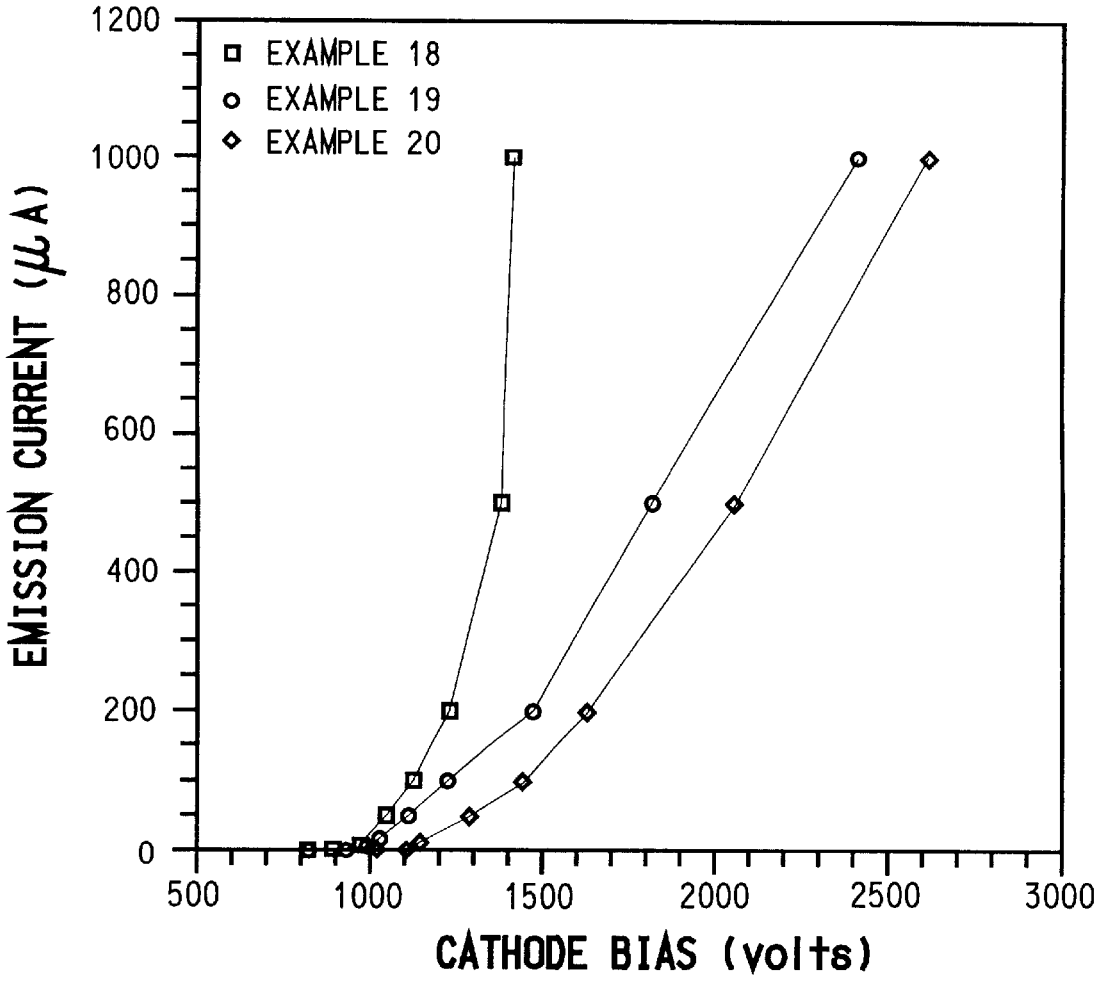
FIG. 9 shows the emission results for the electron emitters of Examples 18–20 with emission current plotted as a function of applied voltage.
Figure 10:
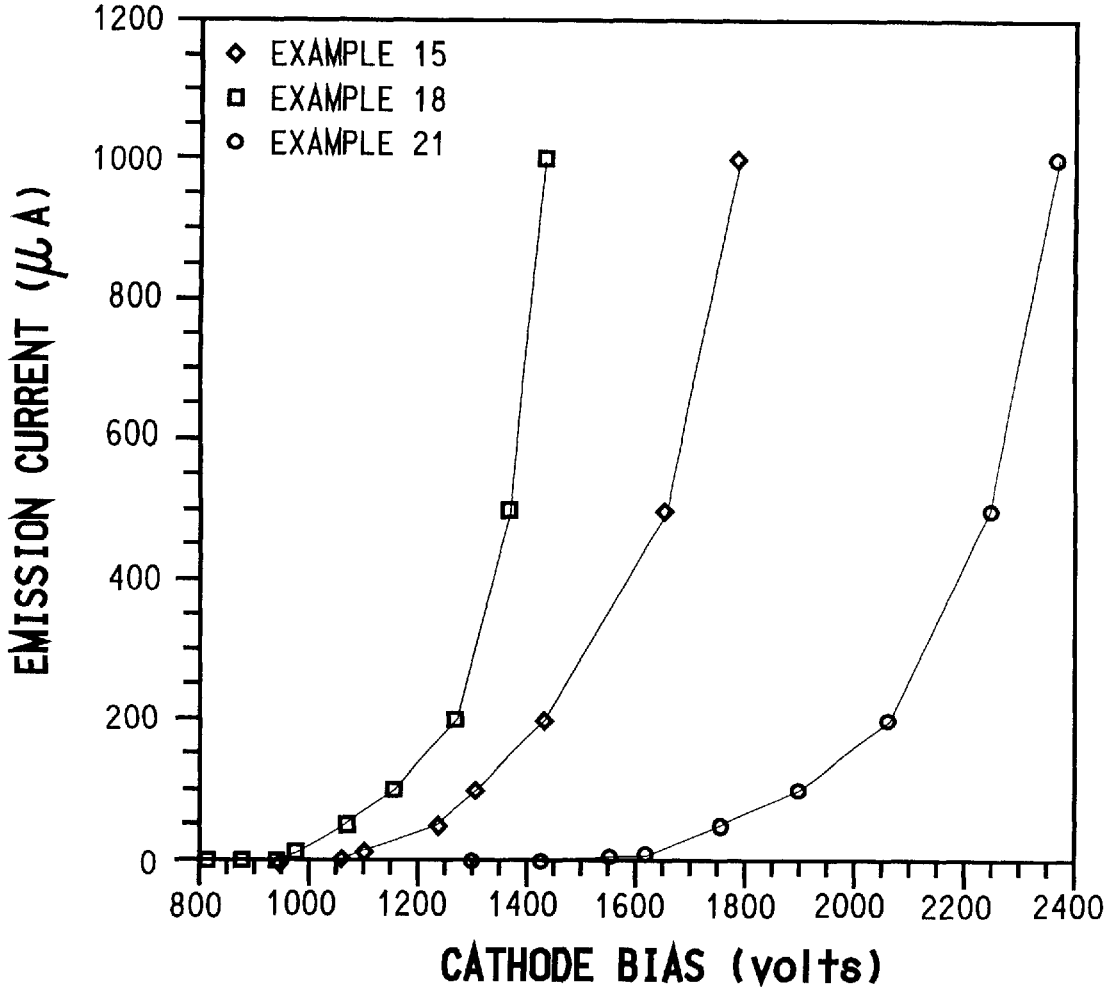
FIG. 10 shows the emission results for the electron emitters of Examples 15, 18 and 21 with emission current plotted as a function of applied voltage.

The emission results for the electron emitters of Examples 15–17 are plotted in FIG. 8 and those for the electron emitters of Examples 18–20 are plotted in FIG. 9. Example 15 with composition 90% Ar/10% $O_2$ shows better emission properties than Examples 16 and 17 and Example 18 with composition 90% Ar/10% $N_2$ shows better emission properties than Examples 19 and 20. The emission results for the electron emitters of Examples 15, 18 and 21 are plotted in FIG. 10 and clearly show the advantage of having about 10% $N_2$ or about 10% $O_2$ in the gas used for the ion bombardment. About 10% $N_2$ is especially effective in improving emission properties.

Examples 22–25

Electron emitters were prepared in each of these Examples using the following procedure.

In each of these Examples a paste comprised of graphite particles and glass frit was screen printed onto a glass substrate and fired to form a layer of composite which comprises graphite particles and glass. These Examples show the effect of the temperature at which the composite was fired on the emission properties of the electron emitters.

Paste prepared for Example 8 was used to make four samples, one for each of the Examples. Each sample was made by applying the paste to a 1 inch×1 inch (2.5 cm×2.5 cm) glass slide using a 200 mesh screen. The dried paste of the samples of Examples 22–25 were heated to firing temperatures of 450° C., 475° C., 500° C. and 525° C. respectively. Each sample was fired in air by increasing the temperature at a rate of 20° C. per minute to the firing temperature, maintaining the temperature at the firing temperature for 10 minutes, and then cooling to ambient temperature by decreasing the temperature at a rate of 20° C. per minute. The result was the formation of a layer of composite which comprises graphite particles and glass on a substrate.

For each sample, a mask was used to expose a 1 cm×1 cm area of the 1 inch×1 inch (2.5 cm×2.5 cm) sample and the surface area of the layer of composite in the exposed region was subjected to argon ion beam bombardment under the following conditions: ion beam made a 90° angle of incidence with the plane of the sample, i.e., was normal to the surface of the layer of composite, beam current of 10 mA, beam voltage of 1.4 kV, ion beam gun-sample distance of 4 inches (10 cm), beam diameter at sample of 2 inches (5 cm), argon partial pressure of $1.5\times10^{-4}$ torr ($2.0\times10^{-2}$ Pa), and exposure time of 45 minutes.

Emission results from the 1 cm×1 cm area which had been ion bombarded were obtained by placing the glass slide containing the screen printed ion-bombarded graphite particles on the copper block cathode of the measurement unit described above. Two pieces of conducting copper tape were applied at each side of the substrate both to hold the substrate in place and to provide electrical contact to the screen printed sample. The separation distance of the surface of the screen printed sample and the copper block anode was 0.6 mm. The system was evacuated to a base pressure of $2.0\times10^{-6}$ torr ($2.7\times10^{-4}$ Pa) for Example 22, $1.5\times10^{-7}$ torr ($2.0\times10^{-5}$ Pa) for Example 23, $1.3\times10^{-6}$ torr ($1.7\times10^{-4}$ Pa) for Example 24 and $2.8\times10^{-6}$ torr ($3.7\times10^{-4}$ Pa) for Example 24. The emission current was measured as a function of voltage. The voltage was increased until the emission current reached 1000 $\mu$A.

Figure 11:
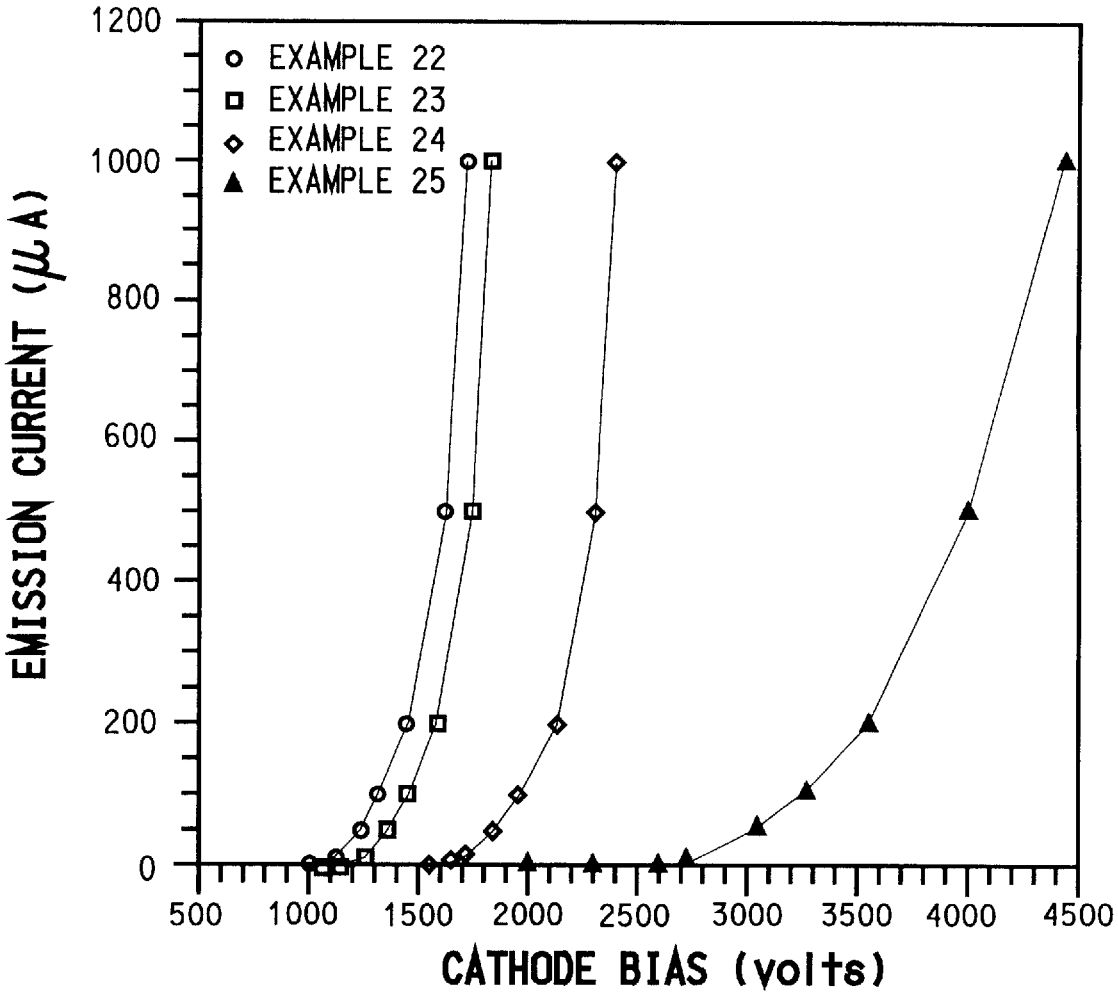
FIG. 11 shows the emission results for the electron emitters of Examples 22–25 with emission current plotted as a function of applied voltage.

The emission results for the electron emitters of Examples 22–25 are plotted in FIG. 11. The samples of Examples 22–24 which were fired at 450° C., 475° C. and 500° C. show similar emission characteristics while that of Example 25 which was fired at 525° C. shows higher voltages needed for turn-on of the emission and for 1 mA emission current.

Examples 26–29

Electron emitters were prepared in each of these Examples using the following procedure.

In each of these Examples a paste comprised of graphite particles and glass frit was screen printed onto a glass substrate and fired to form a layer of composite which comprises graphite particles and glass. These Examples show the effect of the thickness of the fired layer of composite on the emission properties of the electron emitters.

Paste prepared for Example 8 was used to make four samples, one for each of the Examples. Each sample was made by applying the paste to a 1 inch×1 inch (2.5 cm×2.5 cm) glass slide using a 325 mesh screen and different thicknesses were applied for the four Examples. The dried paste was then fired in air by increasing the temperature at a rate of 20° C. per minute to a temperature of 525° C., maintaining the temperature at 525° C. for 10 minutes, and then cooling to ambient temperature by decreasing the temperature at a rate of 20° C. per minute. The thickness of the layer of composite after firing was 14.4, 11.0, 7.7 and 6.4 $\mu$m respectively for the layers of Examples 26–29. The result was the formation of a layer of composite which comprises graphite particles and glass on a substrate.

For each sample, a mask was used to expose a 1 cm×1 cm area of the 1 inch×1 inch (2.5 cm×2.5 cm) sample and the surface area of the layer of composite in the exposed region was subjected to argon ion beam bombardment under the following conditions: ion beam made a 90° angle of incidence with the plane of the sample, i.e., was normal to the surface of the layer of composite, beam current of 10 mA, beam voltage of 1.4 kV, ion beam gun-sample distance of 4 inches (10 cm), beam diameter at sample of 2 inches (5 cm), argon partial pressure of $1.5\times10^{-4}$ torr ($2.0\times10^{-2}$ Pa), and exposure time of 45 minutes.

Emission results from the 1 cm×1 cm area which had been ion bombarded were obtained by placing the glass slide containing the screen printed ion-bombarded graphite particles on the copper block cathode of the measurement unit described above. Two pieces of conducting copper tape were applied at each side of the substrate both to hold the substrate in place and to provide electrical contact to the screen printed sample. The separation distance of the surface of the screen printed sample and the copper block anode was 0.6 mm. The system was evacuated to a base pressure of $4.8\times10^{-6}$ torr ($6.4\times10^{-4}$ Pa) for Example 26, $2.6\times10^{-6}$ torr ($3.5\times10^{-5}$ Pa) for Example 27, $1.2\times10^{-7}$ torr ($1.6\times10^{-5}$ Pa) for Example 28 and $7.7\times10^{-7}$ torr ($1.0\times10^{-4}$ Pa) for Example 29. The emission current was measured as a function of voltage. The voltage was increased until the emission current reached 1000 $\mu$A.

Figure 12:
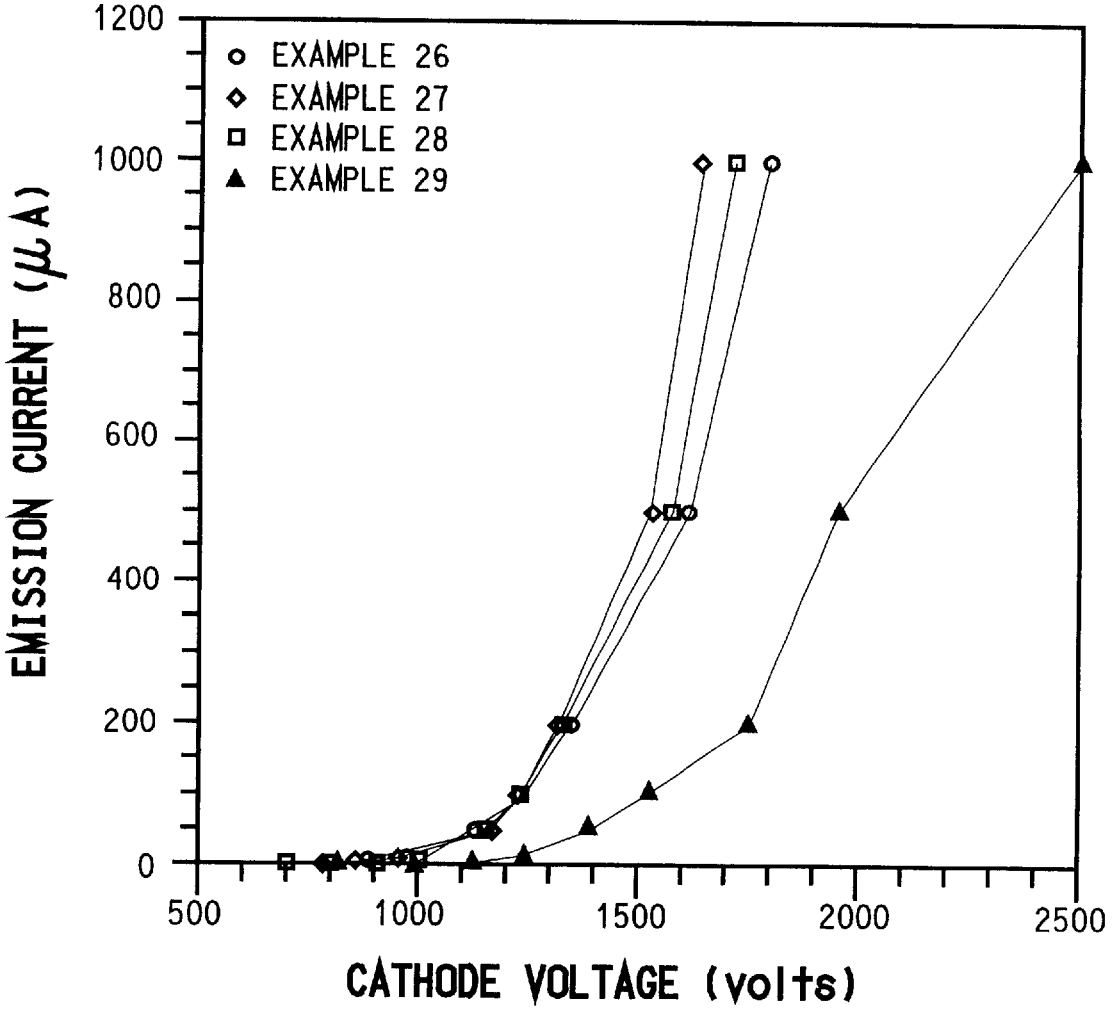
FIG. 12 shows the emission results for the electron emitters of Examples 26–29 with emission current plotted as a function of applied voltage.

The emission results for the electron emitters of Examples 26–29 are plotted in FIG. 12. The sample of Example 29 with the fired thickness of 6.4 $\mu$m was etched through to the substrate during the ion beam bombardment. The layer of composite remained continuous but the emission properties were not as good as those of Examples 26–28. These results show that the emission is not dependent on the thickness of the fired layer of composite as long as the layer of composite is of sufficient thickness to prevent etching through the layer during the ion beam bombardment and the time of ion beam bombardment is sufficient to result in the formation of whiskers and cones on the graphite particles.

Examples 30–34

Electron emitters were prepared in each of these Examples using the following procedure.

In each of these Examples a paste comprised of graphite particles and Pb-free glass frit was screen printed onto a substrate and fired to form a layer of composite which comprises graphite particles and glass. The substrate was comprised of a layer of silver conductor composition on a glass slide. These Examples show the effect of the ion beam bombardment time on the emission properties of the electron emitters.

Five samples with a layer of composite which comprises graphite particles and glass on a silver composite layer/glass slide substrate were prepared essentially as described for Examples 15–21 using the same paste and firing conditions as used for those Examples.

For each sample, a mask was used to expose a 1 cm×1 cm area of the 1 inch×1 inch (2.5 cm×2.5 cm) sample and the surface area of the layer of composite in the exposed region was subjected to ion beam bombardment for different lengths of time. The gas composition used for the ion beam bombardment was 90% Ar/10% $N_2$ by volume.

The following ion beam conditions were used for all five samples: ion beam made a 90° angle of incidence with the plane of the sample, i.e., was normal to the surface of the layer of composite, beam current of 10 mA, beam voltage of 1.4 kV, ion beam gun-sample distance of 4 inches (10 cm), beam diameter at sample of 2 inches (5 cm), partial pressure of $1.5\times10^{-4}$ torr ($2.0\times10^{-2}$ Pa). The exposure times were 5, 10, 15, 30 and 45 minutes for Examples 30–34 respectively.

Emission results from the 1 cm×1 cm area which had been ion bombarded were obtained by placing the glass slide containing the screen printed ion-bombarded graphite particles on the copper block cathode of the measurement unit described above. Two pieces of conducting copper tape were applied at each side of the substrate both to hold the substrate in place and to provide electrical contact to the silver composite layer. The separation distance of the surface of the screen printed sample and the copper block anode was 0.6 mm. The system was evacuated to a base pressure of below $5\times10^{-6}$ torr ($6.7\times10^{-4}$ Pa). The emission current was measured as a function of voltage. The voltage was increased until the emission current reached 1000 $\mu$A.

Figure 13:
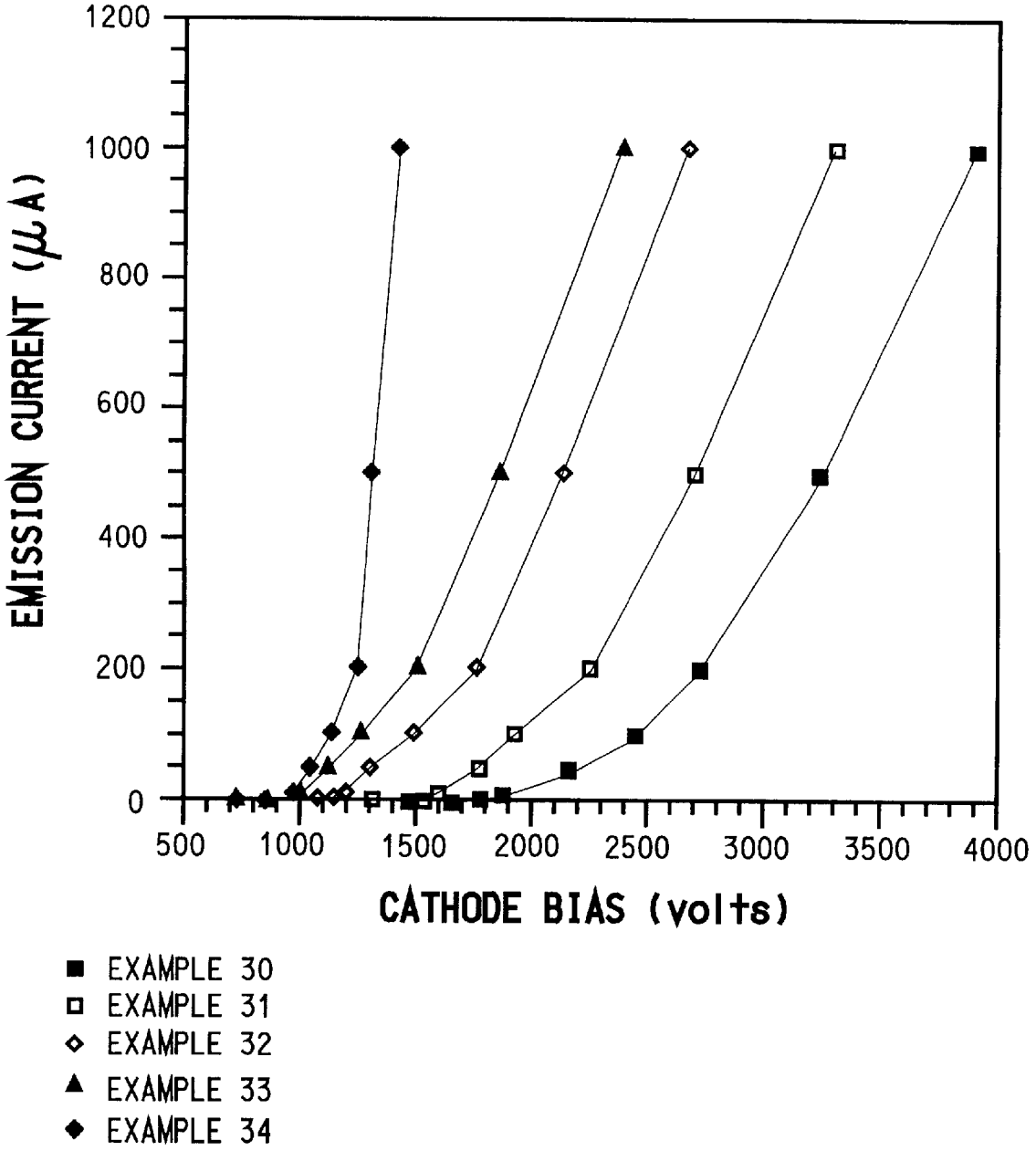
FIG. 13 shows the emission results for the electron emitters of Examples 30–34 with emission current plotted as a function of applied voltage.

The emission results for the electron emitters of Examples 30–34 are plotted in FIG. 13. The emission characteristics improve with increasing exposure time. The voltage required to attain an emission current of 1000 $\mu$A decreases as the exposure time increases. For Example 30 which had a 5 minute exposure time, the voltage required to attain 1000

$\mu$A emission current was nearly 4000 volts. For Example 34 which had a 45 minute exposure time, the voltage required to attain 1000 $\mu$A emission current was about 1400 volts.

Examples 35–37

Electron emitters were prepared in each of these Examples using the following procedure.

In each of these Examples a paste comprised of graphite particles and Pb-free glass frit is screen printed onto a substrate and fired to form a layer of composite which comprises graphite particles and glass. The substrate is comprised of a layer of silver conductor composition on a glass slide. These Examples show the effect of angle of incidence of the ion beam on the emission properties of the electron emitters.

Three samples with a layer of composite which comprises graphite particles and glass on a silver composite layer/glass slide substrate were prepared essentially as described for Examples 15–21 using the same paste and firing conditions as used for those Examples.

For each sample, a mask was used to expose a 1 cm×1 cm area of the 1 inch×1 inch (2.5 cm×2.5 cm) sample and the surface area of the layer of composite in the exposed region was subjected to argon ion beam bombardment under the following conditions: ion beam made a 90°, 60° and 45° angle of incidence with the plane of the sample for Examples 35–37 respectively, beam current of 10 mA, beam voltage of 1.4 kV, ion beam gun-sample distance of 4 inches (10 cm), beam diameter at sample of 2 inches (5 cm), argon partial pressure of $1.5\times10^{-4}$ torr ($2.0\times10^{-2}$ Pa), and exposure time of 45 minutes.

Emission results from the 1 cm×1 cm area which had been ion bombarded were obtained by placing the glass slide containing the screen printed ion-bombarded graphite particles on the copper block cathode of the measurement unit described above. Two pieces of conducting copper tape were applied at each side of the substrate both to hold the substrate in place and to provide electrical contact to the silver composite layer. The separation distance of the surface of the screen printed sample and the copper block anode was 0.6 mm. The system was evacuated to a base pressure of below $5\times10^{-6}$ torr ($6.7\times10^{-4}$ Pa). The emission current was measured as a function of voltage. The voltage was increased until the emission current reached 1000 $\mu$A.

Figure 14:
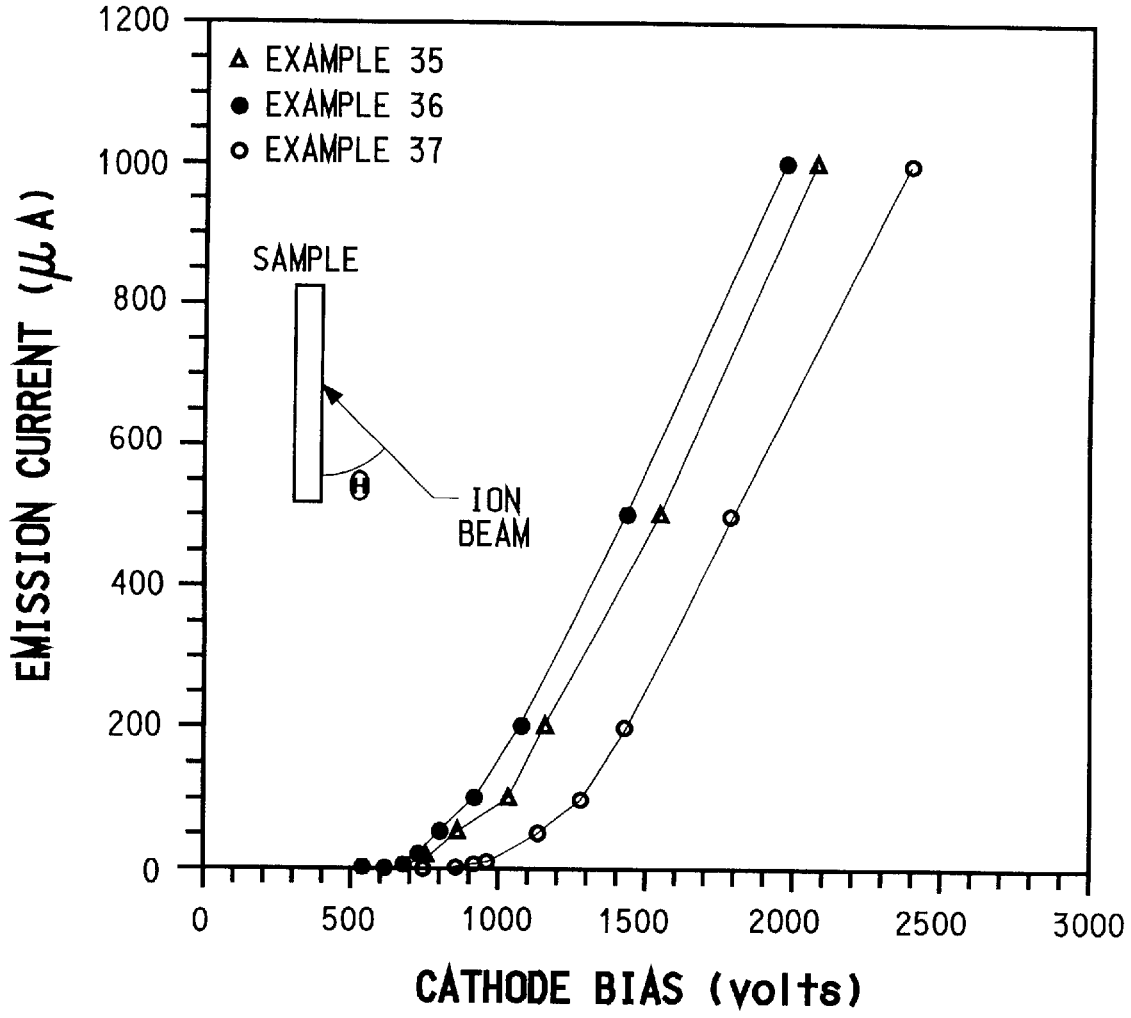
FIG. 14 shows the emission results for the electron emitters of Examples 35–37 with emission current plotted as a function of applied voltage.

The emission results for the electron emitters of Examples 35–37 are plotted in FIG. 14. The emission characteristics do not vary greatly for the various angles of incidence of the ion beam.

Examples 38–41

Electron emitters were prepared in each of these Examples using the following procedure.

In each of these Examples a paste comprised of graphite particles and Pb-free glass frit was screen printed onto a substrate and fired to form a layer of composite which comprises graphite particles and glass. The substrate is comprised of a layer of silver conductor composition on a glass slide.

Four samples with a layer of composite which comprises graphite particles and glass on a silver composite layer/glass slide substrate were prepared essentially as described for Examples 15–21 using the same paste and firing conditions as used for those Examples.

For each sample, a mask was used to expose a 1 cm×1 cm area of the 1 inch×1 inch (2.5 cm×2.5 cm) sample and the surface area of the layer of composite in the exposed region was subjected to argon ion beam bombardment under the following conditions: ion beam made a 90° angle of incidence with the plane of the sample, i.e., was normal to the surface of the layer of composite, beam current of 10 mA, beam voltage of 1.4 kV, ion beam gun-sample distance of 4 inches (10 cm), beam diameter at sample of 2 inches (5 cm), argon partial pressure of $1.5\times10^{-4}$ torr ($2.0\times10^{-2}$ Pa), and exposure time of 45 minutes.

Emission results from the 1 cm×1 cm area which had been ion bombarded were obtained by placing the glass slide containing the screen printed ion-bombarded graphite particles on the copper block cathode of the measurement unit described above. Two pieces of conducting copper tape were applied at each side of the substrate both to hold the substrate in place and to provide electrical contact to the silver composite layer. The separation distance of the surface of the screen printed sample and the copper block anode was 0.6 mm. The system was evacuated to a base pressure of $3\times10^{-6}$ torr ($4\times10^{-4}$ Pa). The emission current was measured as a function of voltage. The voltage was increased until the emission current reached 1000 $\mu$A.

Figure 15:
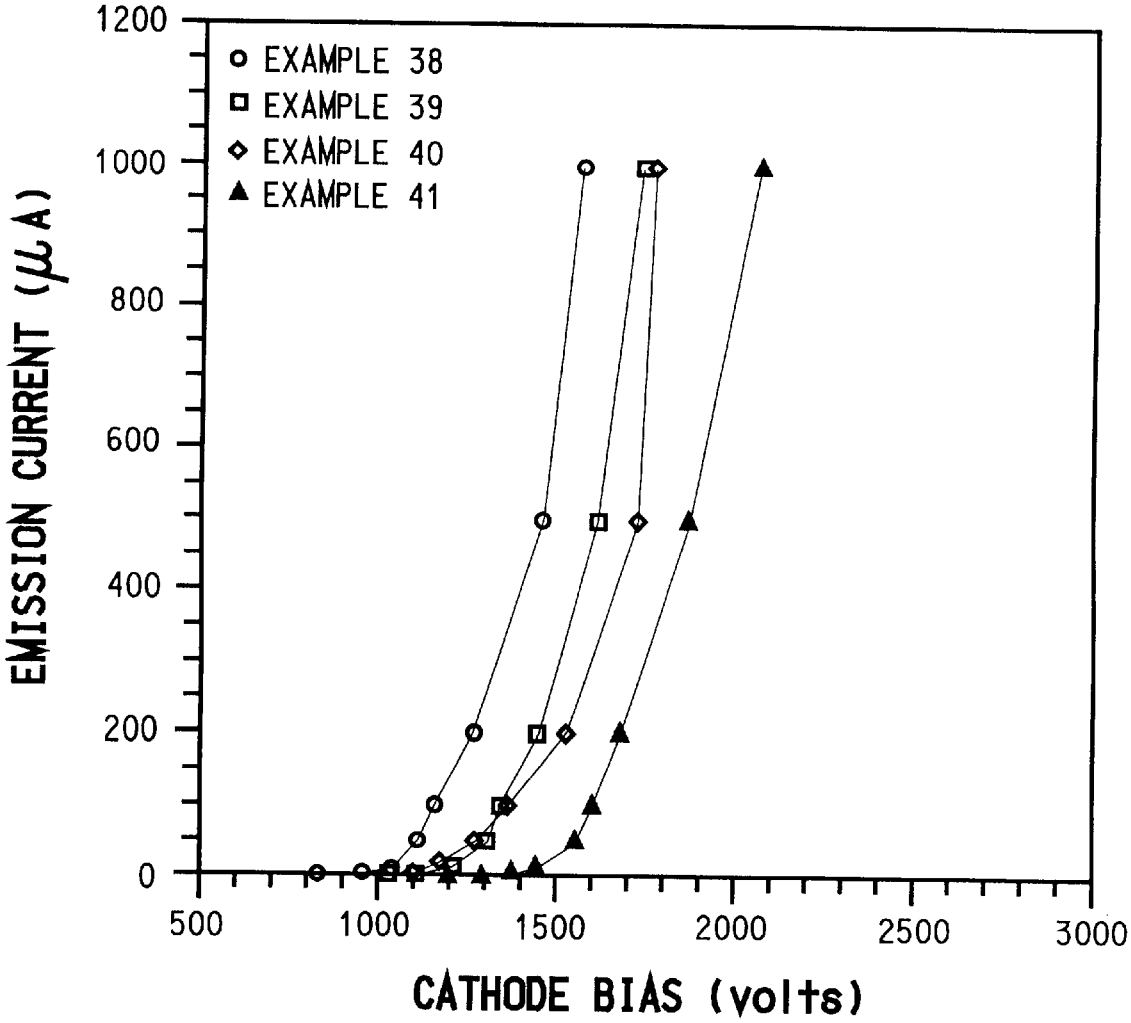
FIG. 15 shows the emission results for the electron emitters of Examples 38–41 with emission current plotted as a function of applied voltage.

The emission results for the electron emitters of Examples 38–41 are plotted in FIG. 15. The voltage required to produce an emission current of 1000 $\mu$A varies from about 1500 V to about 2000 V for these four samples.

Example 42

A triode device was prepared using the following procedure to demonstrate the use of the electron emitter of the invention in a flat panel display. The triode is shown schematically in FIG. 16 which is referenced in the procedure description.

A layer of composite 1 which comprises graphite particles and glass on a silver composite layer 2/glass slide 3 substrate was prepared essentially as described for Examples 15–21 using the same paste and firing conditions as used for those Examples.

A mask was used to expose a 1 cm×1 cm area of the 1 inch×1 inch (2.5 cm×2.5 cm) sample and the surface area of the layer of graphite/glass composite in the exposed region was subjected to ion beam bombardment using an argon ion beam.

The following ion beam conditions were used for this sample: ion beam made a 90° angle of incidence with the plane of the sample, i.e., was normal to the surface of the layer of composite, beam current of 10 mA, beam voltage of 1.4 kV, ion beam gun-sample distance of 4 inches (10 cm), beam diameter at sample of 2 inches (5 cm), partial pressure of $1.5\times10^{-4}$ torr ($2.0\times10^{-2}$ Pa), and exposure time of 45 minutes.

This ion beam treated layer of composite on the substrate of silver composite layer/glass slide serves as the electrode of the triode.

Figure 16:
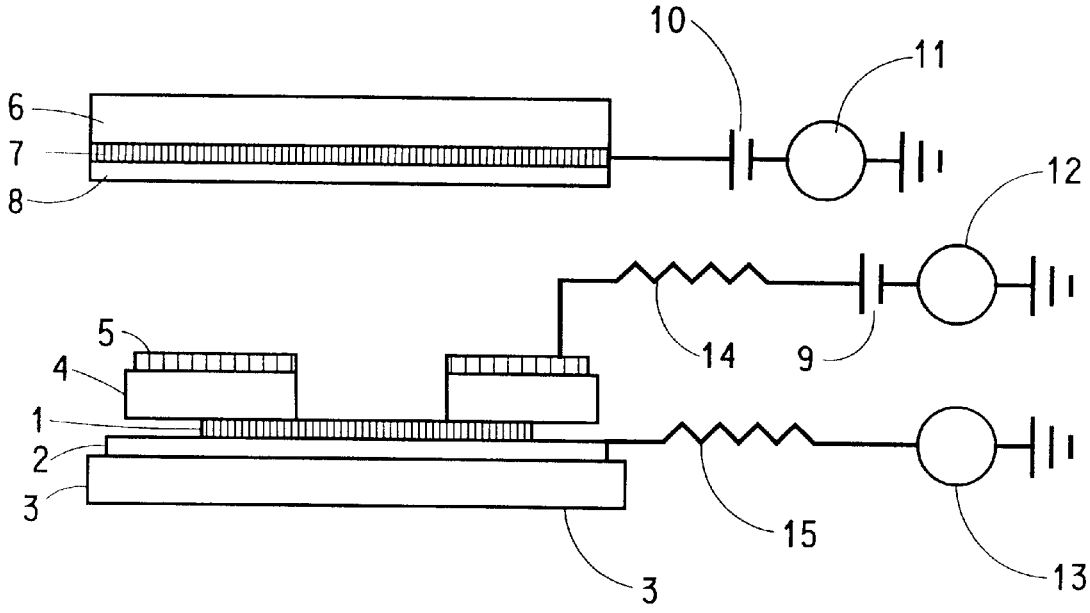
FIG. 16 is a schematic drawing of a triode structure electron emission device.

For convenience, a glass cover slip 4 with a thickness of 100 $\mu$m served as an insulator between the cathode and the gate electrode 5. The gold gate electrode was deposited onto the glass cover by dc sputtering. The glass coverslip was placed on a substrate platen of a dc sputtering system underneath a 6 inch (15 cm), 99.999% pure gold target. The chamber was pumped down to $1\times10^{-6}$ torr ($1.3\times10^{-4}$ Pa) base pressure. Argon gas was introduced and the chamber pressure was brought up to the sputtering pressure of 10 mtorr (1.3 Pa). A dc power of 100 Watts was applied to the gold target and the sputtering was carried out for 50 minutes. The deposition rate was 20 nm/minute and the resulting gold film was 1 μm thick. Four holes, each with a diameter of 700 μm, were machined in the gold coated glass cover slip. The glass cover slip was then placed on the ion beam treated layer of composite as shown in FIG. 16 so that this layer was exposed through the four holes and thereby provided four areas as the emitter from which electron emission could occur.

The anode was a glass slide 6 on which was deposited first a transparent conducting 20 ohm per square indium tin oxide film 7 followed by a several micron thick layer of ZnO phosphor 8.

The spacing between the gate electrode 5 and the phosphor film 8 on the anode was 4 mm.

Figure 17:
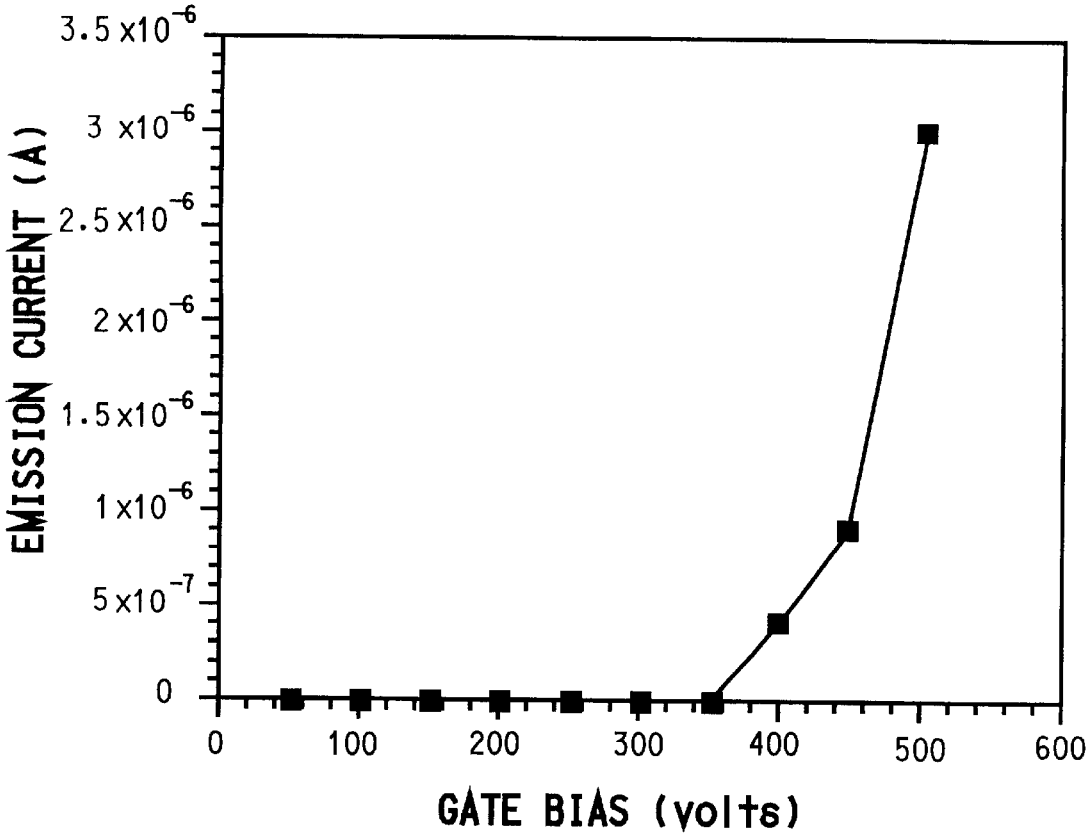
FIG. 17 shows the emission results for the triode structure of Example 42 with emission current plotted as a function of applied gate bias voltage.

To measure the emission current, variable voltage sources 9 and 10 were connected to the gate electrode 5 and the indium tin oxide film 7 of the anode. Both were biased positive with respect to the cathode. Ammeters 11, 12 and 13 were used to measure the various currents as shown and 1 MΩ resistors were placed in the cathode and gate electrode connections. FIG. 17 is a plot of emission current versus applied gate bias voltage at a constant anode voltage of 5 kV with respect to the cathode. Turn-on of emission occurred at a gate bias voltage of about 350 V with respect to the cathode and a single spot of light was observed emitting from the phosphor. When the gate bias voltage was increased to 500 V, emission occurred form all four areas of the emitter and four spots of light were observed emitting from the phosphor. The total emission current was about 3 μA, corresponding to a current density of about 0.2 mA/cm$^2$. There was no leakage current observed at the gate electrode. There was some hysteresis and the turn-off voltage was 200V.

The observed dependence of emission current on anode voltage is believed to be a result of the relatively thick glass cover slip used to space the gate electrode from the cathode. The use of thinner insulators should eliminate this dependence of the emission current on the anode voltage.

This Example demonstrates the triode device and the use of the electron emitter in a flat panel display.

Examples 43–45

Three triode devices were prepared using the following procedure to demonstrate the use of the electron emitter of the invention in a flat panel display. The triode configuration is essentially that shown in Example 42. These Examples show the effect of the thickness of the insulator between the cathode and the gate electrode.

Three samples with a layer of composite which comprises graphite particles and glass on a silver composite layer/glass slide substrate was prepared essentially as described for Examples 15–21 using the same paste and firing conditions as used for those Examples.

For each sample, a mask was used to expose a 1 cm×1 cm area of the 1 inch×1 inch (2.5 cm×2.5 cm) sample and the surface area of the layer of graphite/glass composite in the exposed region was subjected to ion beam bombardment using an argon ion beam.

The following ion beam conditions were used for this sample: ion beam made a 90° angle of incidence with the plane of the sample, i.e., was normal to the surface of the layer of composite, beam current of 10 mA, beam voltage of 1.4 kV, ion beam gun-sample distance of 4 inches (10 cm), beam diameter at sample of 2 inches (5 cm), partial pressure of $1.5\times10^{-4}$ torr ($2.0\times10^{-2}$ Pa), and exposure time of 45 minutes.

This ion beam treated layer of composite on the substrate of silver composite layer/glass slide serves as the electrode of the triode.

The insulators used between the cathode and the gate electrode were 1 inch×1 inch (2.5 cm×2.5 cm) squares of Mylar® film, 12 μm, 18 μm, and 25 μm thick for Examples 43–45, respectively. In each film, four holes were formed by laser ablation using a focused $CO_2$ laser. The nominal hole diameter was 70 μm. Gold electrodes were then deposited on the Mylar® films by dc sputtering. The Mylar® films were placed on a substrate platen of a dc sputtering system underneath 6 inch (15 cm), 99.999% pure gold target. The films were placed at an angle of 60° with respect to the target surface to avoid film deposition inside the laser drilled holes. The chamber was pumped down to $1\times10^{-6}$ torr ($1.3\times10^{-4}$ Pa) base pressure. Argon gas was introduced and the chamber pressure was brought up to the sputtering pressure of 10 mtorr (1.3 Pa). A dc power of 100 Watts was applied to the gold target and the sputtering was carried out for 10 minutes. The deposition rate was 20 nm/minute and the resulting gold film was 0.2 μm thick. The Mylar® film was then placed on the ion beam treated layer of composite as shown in FIG. 16 so that this layer was exposed through the four holes and thereby provided four areas as the emitter from which electron emission could occur.

The anode used was essentially the same as that used in Example 42. The spacing between the gate electrode and the phosphor film on the anode was 4 mm.

Figure 18:
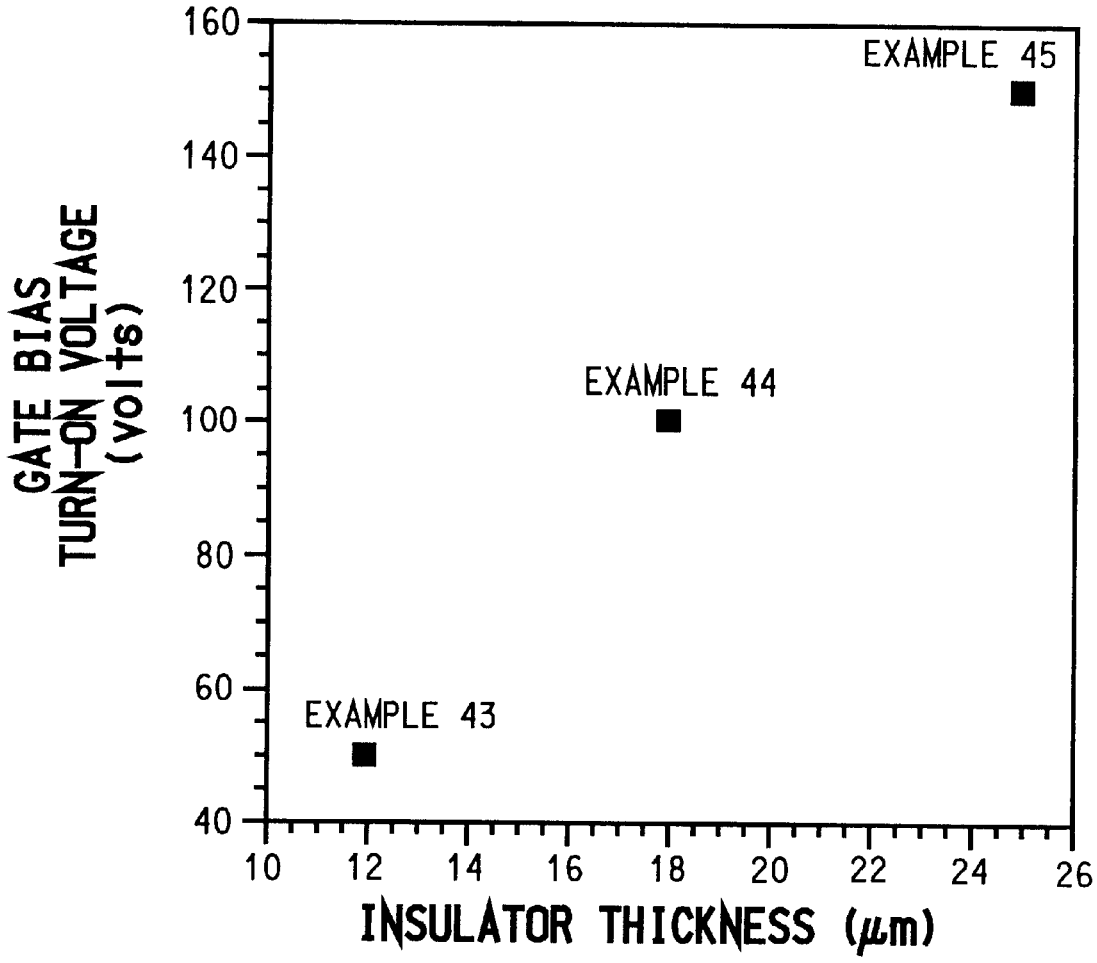
FIG. 18 shows the gate bias turn-on voltage for the on-set of emission for the triode structures of Examples 43–45.

To measure the emission current, variable voltage sources were connected to the gate electrode and the indium tin oxide film of the anode. Both were biased positive with respect to the cathode. FIG. 18 is a plot of the gate bias turn-on voltage for the on-set of emission as a function of the insulator thickness. The gate bias turn-on voltage decreased from 150V for Example 45 with an insulator thickness of 25 μm to 50V for Example 43 with an insulator thickness of 12 μm. Light was observed emitting from one spot on the phosphor at onset of emission and was observed from four spots on the phosphor as the gate bias voltage was increased.

These Examples demonstrate the triode device and the use of the electron emitter in a flat panel display.

Although particular embodiments of the present invention have been described in the foregoing description, it will be understood by those skilled in the art that the invention is capable of numerous modifications, substitutions and rearrangements without departing from the spirit or essential attributes of the invention. Reference should be made to the appended claims, rather than to the foregoing specification, as indicating the scope of the invention.

What is claimed is:

1. A process for producing a field emission electron emitter, which comprises:

(a) forming a layer of composite which comprises graphite particles and glass on a substrate, wherein said glass adheres to said substrate and to portions of said graphite particles thereby affixing said graphite particles to one another and to said substrate and wherein at least 50% of the surface area of said layer of composite consists of portions of said graphite particles; and (b) bombarding the surface of the layer formed in (a) with an ion beam which comprises ions of argon, neon, krypton or xenon for a time sufficient to form whiskers on said graphite particles.

2. The process of claim 1, wherein said ion beam comprises ions of argon.

3. The process of claim 2, wherein said ion beam further comprises ions of nitrogen.

4. The process as in any one of claims 1–3, wherein at least 70% of the surface area of said layer of composite consists of portions of said graphite particles.

5. The process as in any one of claims 1–3, wherein the volume per cent of said graphite particles is about 35% to about 80% of the total volume of said graphite particles and said glass.

6. The process of claim 5, wherein the volume per cent of said graphite particles is about 50% to about 80% of the total volume of said graphite particles and said glass.

7. The process of claim 3, wherein the ion beam gas is from about 85 to about 92 volume percent argon and from about 8 to about 15 volume percent nitrogen.

8. The process of claim 2, wherein said ion beam further comprises ions of oxygen.

9. The process as in any one of claims 2, 3, 7 or 8, wherein said ion beam has an ion current density of from about 0.1 $mA/cm^2$ to about 1.5 $mA/cm^2$ and a beam energy of from about 0.5 keV to about 2.5 keV and the time of ion bombardment is from about 15 to about 90 minutes.

10. The process of claim 9, wherein the time of ion bombardment is from about 40 to about 50 minutes.

11. The process of claim 2, wherein said layer of composite is formed by a process, which comprises:

(a) screen printing a paste comprised of graphite particles and glass frit onto said substrate in a desired pattern, wherein the volume per cent of said graphite particles is about 35% to about 80% of the total volume of said graphite particles and said glass frit; and (b) firing the dried patterned paste to soften said glass frit and cause it to adhere to said substrate and to portions of said graphite particles thereby affixing said graphite particles to one another and to said substrate to produce said layer of composite.

12. The process of claim 2, wherein said layer of composite is formed by a process, which comprises:

(a) screen printing a paste comprised of graphite particles, glass frit, a photoinitiator and a photohardenable monomer onto said substrate, wherein the volume per cent of said graphite particles is about 35% to about 80% of the total volume of said graphite particles and said glass frit;

(b) photopatterning the dried paste; and (c) firing the patterned dried paste to soften said glass frit and cause it to adhere to said substrate and to portions of said graphite particles thereby affixing said graphite particles to one another and to said substrate to produce said layer of composite.

13. The process as in claim 11 or 12, wherein said paste is comprised of from about 40 wt % to about 60 wt % solids comprised of graphite particles and glass frit, the weight percentage being based on the total weight of said paste.

14. The process of claim 13, wherein said substrate comprises glass and said firing is at a temperature of about 450° C. to about 575° C. for about 10 minutes.

15. The process of claim 14, wherein said firing is at a temperature of about 450° C. to about 525° C. for about 10 minutes.

16. The process as in any one of claims 2, 11 or 12, wherein said glass is lead-free.

17. The process as in claim 11 or 12, wherein the thickness of the fired layer of composite is from about 10 $\mu$m to about 30 $\mu$m and said ion beam further comprises ions of nitrogen.

18. An electron emitter made by the process of any one of claims 2, 11, or 12.

19. A flat panel display comprising the,electron emitter of claim 18.

20. The flat panel display of claim 19, further comprising at least one gate electrode.

21. The process as in any one of claims 1, 2, 11, or 12, wherein a mask covers any portions of said substrate which would otherwise be exposed to said ion beam.

22. The process of claim 21, wherein said mask is a graphite mask.

23. The process of claim 21, wherein said mask further covers any portions of said layer of composite that are not to be exposed to said ion beam.

24. The process of claim 23, wherein said mask is a graphite mask.

25. A process for forming a layer of composite which comprises graphite and glass on a substrate, which comprises:

(a) screen printing a paste comprised of graphite particles and glass frit onto the substrate in a desired pattern, wherein the volume per cent of said graphite particles is about 35% to about 80% of the total volume of the said graphite particles and said glass frit; and (b) firing the dried patterned paste to soften said glass frit and cause it to adhere to said substrate and to portions of said graphite particles thereby affixing said graphite particles to one another and to said substrate to produce said layer of composite, wherein at least 50% of the surface area of said layer of composite consists of portions of said graphite particles.

26. The process of claim 25, wherein the volume per cent of said graphite particles is about 50% to about 80% of the total volume of the said graphite particles and said glass frit and at least 70% of the surface area of said layer of composite consists of portions of said graphite particles.

27. A process for producing a field emission electron emitter, which comprises forming a layer of composite which comprises carbon nanotubes and glass on a substrate, wherein said glass adheres to said substrate and to portions of said carbon nanotubes thereby affixing said carbon nanotubes to one another and to said substrate and wherein at least 50% of the surface area of said layer of composite consists of portions of said carbon nanotubes.

28. The process of claim 27, wherein said layer of composite is formed by a process, which comprises:

(a) screen printing a paste comprised of carbon nanotubes and glass frit onto said substrate in the desired pattern, wherein the volume per cent of said carbon nanotubes is about 35% to about 80% of the total volume of said carbon nanotubes and said glass frit; and (b) firing the dried patterned paste to soften said glass frit and cause it to adhere to said substrate and to portions of said carbon nanotubes thereby affixing said carbon nanotubes to one another and to said substrate to produce said layer of composite.

29. The process of claim 27, wherein said layer of composite is formed by a process, which comprises:

(a) screen printing a paste comprised of carbon nanotubes, glass frit, a photoinitiator and a photohardenable monomer onto said substrate, wherein the volume per cent of said carbon nanotubes is about 35% to about 80% of the total volume of said carbon nanotubes and said glass frit;

(b) photopatterning the dried paste; and (c) firing the patterned dried paste to soften said glass frit and cause it to adhere to said substrate and to portions of said carbon nanotubes thereby affixing said carbon nanotubes to one another and to said substrate to produce said layer of composite.

30. The process as in claim 28 or 29, wherein said paste is comprised of from about 40 wt % to about 60 wt % solids comprised of carbon nanotubes and glass frit, the weight percentage being based on the total weight of said paste.

31. The process as in any one of claims 27–29, wherein said carbon nanotubes are single wall carbon nanotubes.

32. An electron emitter made by the process of claim 31.

33. A flat panel display comprising the electron emitter of claim 32.

34. The flat panel display of claim 33, further comprising at least one gate electrode.

35. An electron emitter made by the process of any one of claims 27–29.

36. A flat panel display comprising the, electron emitter of claim 35.

37. The flat panel display of claim 36, further comprising at least one gate electrode.

* * * * *